United States Patent [19]

Hida et al.

[11] 4,269,045

[45] May 26, 1981

[54] HOME KNITTING MACHINE FOR PRODUCING PROGRAMMED DESIGNS

[75] Inventors: Takashi Hida, Toyota; Tsutomu Mitsui, Chityu; Kazutaka Kuwana; Tadaaki Hashiride, both of Toyota, all of Japan

[73] Assignee: Aisin Seiki Kabushiki Kaisha, Kariya, Japan

[21] Appl. No.: 891,777

[22] Filed: Mar. 30, 1978

[30] Foreign Application Priority Data

Mar. 31, 1977 [JP] Japan ..... 52-37372

[51] Int. Cl.[3] ..... D04B 7/00; D04B 15/66

[52] U.S. Cl. ..... 66/75.2

[58] Field of Search ..... 66/75.2, 154 A, 50 R, 66/25, 232, 238; 235/151.1

[56] References Cited

U.S. PATENT DOCUMENTS

| | | | |
|---|---|---|---|
| 3,817,059 | 6/1974 | Krause | 66/75.2 X |
| 3,825,900 | 7/1974 | Anderson | 66/75.2 X |
| 3,879,963 | 4/1975 | Grozinger | 66/50 R |
| 3,885,405 | 5/1975 | Manfred | 66/75.2 |
| 3,890,806 | 6/1975 | Grozinger | 66/50 R |
| 3,924,244 | 12/1975 | Seitz | 66/50 R X |
| 3,940,953 | 3/1976 | Kouklik | 66/75.2 X |
| 3,983,370 | 9/1976 | Caspi et al. | 66/50 R X |
| 3,983,718 | 10/1976 | Kahan et al. | 66/75.2 |
| 3,991,592 | 11/1976 | Kahan et al. | 66/75.2 |

*Primary Examiner*—Ronald Feldbaum

*Attorney, Agent, or Firm*—Sughrue, Rothwell, Mion, Zinn and Macpeak

[57] ABSTRACT

A home knitting machine is provided with a read only semiconductor memory device which has a plurality of patterning instructions, electric signal generator means for generating carriage position indication signal in response to movement of the carriage during knitting, an electronic control system for reading out instructions from the memory device in response to the carriage position indication signal, needle selectors energized pursuant to read out instructions from the memory device to provide design patterns in a fabric, and an input unit for determining reading out sequence of the electronic control system so as to select a design pattern by manual operation of a user.

7 Claims, 57 Drawing Figures

| Key Switches | Segments Data | | | | | | | | Display |
|---|---|---|---|---|---|---|---|---|---|
| | h | g | f | e | d | c | b | a | |
| | PB7 | PB6 | PB5 | PB4 | PB3 | PB2 | PB1 | PB0 | |
| Ky00 | 0 | 0 | 1 | 1 | 1 | 1 | 1 | 1 | 0 |
| Ky01 | 0 | 0 | 0 | 0 | 0 | 1 | 1 | 0 | 1 |
| Ky02 | 0 | 1 | 0 | 1 | 1 | 0 | 1 | 1 | 2 |
| Ky03 | 0 | 1 | 0 | 0 | 1 | 1 | 1 | 1 | 3 |
| Ky04 | 0 | 0 | 1 | 0 | 1 | 1 | 1 | 0 | 4 |
| Ky05 | 0 | 1 | 1 | 0 | 1 | 1 | 0 | 1 | 5 |
| Ky06 | 0 | 1 | 1 | 1 | 1 | 1 | 0 | 0 | 6 |
| Ky07 | 0 | 0 | 0 | 0 | 0 | 1 | 1 | 1 | 7 |
| Ky08 | 0 | 1 | 1 | 1 | 1 | 1 | 1 | 1 | 8 |
| Ky09 | 0 | 1 | 1 | 0 | 0 | 1 | 1 | 1 | 9 |
| Ky10 | 0 | 0 | 1 | 1 | 1 | 0 | 0 | 1 | C |
| Ky11 | 0 | 1 | 1 | 1 | 1 | 0 | 0 | 1 | E |
| Ky12 | 0 | 1 | 1 | 1 | 0 | 0 | 0 | 1 | F |
| Ky13 | 0 | 0 | 1 | 1 | 1 | 1 | 1 | 0 | U |
| Ky14 | 0 | 0 | 1 | 1 | 1 | 0 | 0 | 0 | L |
| Ky15 | 0 | 1 | 1 | 1 | 0 | 1 | 1 | 1 | A |
| Ky16 | 1 | 0 | 0 | 0 | 0 | 0 | 0 | 0 | . |

Fig. 22

| Key No. | Switch Code 7 | 6 | 5 | 4 | 3 | 2 | 1 | 0 | Hexadecimal Notation |
|---|---|---|---|---|---|---|---|---|---|
| 0 | 0 | 0 | 0 | 0 | 0 | 0 | 0 | 0 | 00H |
| 1 | 0 | 0 | 0 | 0 | 0 | 0 | 0 | 1 | 01H |
| 2 | 0 | 0 | 0 | 0 | 0 | 0 | 1 | 0 | 02H |
| 3 | 0 | 0 | 0 | 0 | 0 | 0 | 1 | 1 | 03H |
| 4 | 0 | 0 | 0 | 0 | 0 | 1 | 0 | 0 | 04H |
| 5 | 0 | 0 | 0 | 0 | 0 | 1 | 0 | 1 | 05H |
| 6 | 0 | 0 | 0 | 0 | 0 | 1 | 1 | 0 | 06H |
| 7 | 0 | 0 | 0 | 0 | 0 | 1 | 1 | 1 | 07H |
| 8 | 0 | 0 | 0 | 0 | 1 | 0 | 0 | 0 | 08H |
| 9 | 0 | 0 | 0 | 0 | 1 | 0 | 0 | 1 | 09H |
| C | 0 | 0 | 0 | 0 | 1 | 0 | 1 | 0 | 0CH |
| E | 0 | 0 | 0 | 0 | 0 | 0 | 1 | 1 | 0EH |
| F | 0 | 0 | 0 | 0 | 1 | 1 | 0 | 0 | 0FH |
| U | 0 | 0 | 0 | 0 | 1 | 1 | 0 | 1 | 0UH |
| L | 0 | 0 | 0 | 0 | 1 | 1 | 1 | 0 | 0LH |
| A | 0 | 0 | 0 | 0 | 1 | 1 | 1 | 1 | 0AH |
| Clear(CLR) | 0 | 0 | 0 | 1 | 0 | 0 | 0 | 0 | 10H |
| OK | 0 | 0 | 0 | 1 | 0 | 0 | 0 | 1 | 11H |
| Lock | 0 | 0 | 0 | 1 | 0 | 0 | 1 | 0 | 12H |
| Pass | 0 | 0 | 0 | 1 | 0 | 0 | 1 | 1 | 13H |
| Design | 0 | 0 | 0 | 1 | 0 | 1 | 0 | 0 | 14H |
| Memory | 0 | 0 | 0 | 1 | 0 | 1 | 0 | 1 | 15H |

HOME KNITTING MACHINE FOR PRODUCING PROGRAMMED DESIGNS

BACKGROUND OF THE INVENTION

The invention relates in general to automated home knitting machines. More particularly, the invention relates to home knitting machines having an electronic control system for reading out design pattern data from a memory device according to predetermined programs to operate needle selectors.

Automated home knitting machines are not well known and are exemplified by the machines of the following patents:

U.S. Pat. No. 3,885,405-issued May 27, 1975
U.S. Pat. No. 3,924,244-issued Dec. 2, 1975
U.S. Pat. No. 3,983,718-issued Oct. 5, 1976
U.S. Pat. No. 3,991,592-issued Nov. 16, 1976

Some of the home knitting machines are provided with a card reader for reading out patterning instructions on a programmed card prior to knitting, a random access memory device (RAM) for storing the signals read from the card, and electronic control system for recalling the stored signals from the memory device in synchronization with movement of the carriage during knitting and for causing the operation of needle selectors in accordance with the recalled signals to provide for the formation in a fabric of a pattern defined on the card (U.S. Pat. No. 3,983,718 and U.S. Pat. No. 3,991,592). The electronic control system comprises a semiconductor IC unit having super-exceeded computation function and being called a micro-computer or micro-processor for recalling the stored signals to provide design patterns in a fabric. With the IC unit, the position, inversion, enlargement and repetition of design patterns may be selected through an input unit by an operator. Thus many variations of a design pattern on a card may be formed on a fabric. However, the home knitting machine requires the operator to interpose a card into a reader head to transfer patterning instructions on a card to the random access memory device. Therefore a reader control circuit or micro-computer program for reading out the patterning instructions on a card and storing it in the memory device with a memory address is required. Generally speaking, home knitting machines are used by house wives who have little knowledge of electronic apparatus. Some of them may find it difficult to operate a card reader and card. Patterning instructions on the card are in quadratic form and the construction of the card reader is somewhat complicated for reading quadratic information. Also the card reader has delicate mechanical elements. Thus the possibility of mechanical troubles or misreading of information may be relatively high and frequent maintenance work or repair may be required.

SUMMARY OF THE INVENTION

One object of the present invention is to simplify design pattern selection by the operator of home knitting machines by eliminating the card reader.

Another object of the present invention is to simplify the mechanisms required and electrical mechanism to introduce patterning instructions into a home knitting machine from outside of the machine.

A further object of the present invention is to simplify the processing logic or micro-computer program of the electronic control system which controls input and output of the patterning instruction signals.

According to the present invention, the home knitting machine is provided with a memory device having fixed informations of standard design patterns. Recently, there have been developed semi-conductor IC memory devices which are compact and have high memory density such as C-MOS memory. Therefore almost all of the patterning instructions recorded on the cards can be memorized in the read only memory device. Each of the standard design patterns is not required to be a meaningful pattern but may be a meaningful or meaningless design pattern unit, wherein "meaningful pattern" means a pattern which demonstrates specific figures such as birds, cars, letters or marks and "meaningless pattern" means a pattern which demonstrates unspecific figures such as lines, curves, dots or a part of a specific figure.

FIG. 1 shows in a viewable form, fixed memory information in the read only memory device of the present invention, wherein the memory device has a memory capacity of $8\times8\times8\times8$ bits (matrix of $8\times8$ lines and $8\times8$ rows). Each of the lines and rows is conceptually divided into 8, each of which construct a memory group (00), (01), . . . or (77). A unit of information of a meaningless basic design pattern is memorized on every memory group as shown in FIG. 1. The informations are storing during the manufacturing procedure of the memory device. Marks $x$ in FIG. 1 denote informations. By selecting a unit of information, combining more than one unit of information and/or controlling read out sequence of the informations, a specific meaningful or meaningless design pattern is obtained. The basic unit design pattern on a memory group of the memory device is available for obtaining some modified design patterns by inverting read out information, reversing read out sequence of the informations, overlapping read out of two or more memory group and/or shifting address of read out information with an electronic control circuit or micro-computer program. Also according to the present invention, some programs for reading out one or more basic unit design patterns to construct a specific design pattern are memorized on the read only memory device or another read only memory device. By supplying a data code, which indicates a specific program for reading out the basic unit design patterns, to electronic control system, informations of the memory groups (00)–(77) are read out from the read only memory in accordance with the specific program. Selection of the specific program corresponds to selection of specific combination design pattern to be knitted in a fabric. Read out informations are supplied to needle selectors under the needle bed. The operators can select one of the specific combination design patterns by selecting program code or program No. and supplying it into the electronic control system through an input unit such as keys. Thus the card reader is eliminated according to the present invention. In case the read only memory device has 64 units of basic design pattern as shown in FIG. 1, the number of read out programs, namely the number of combination design patterns to be knitted in a fabric, are quite large. Therefore, the operator can select many combination design patterns as much as or more than that recorded on cards of the prior home knitting machine.

FIG. 2 shows some combination design patterns which can be constructed with the basic unit design informations shown in FIG. 1 by specifying read out program. A combination design pattern COM 1 in FIG. 2 is obtained from combination of the basic unit design pattern (07) and its rotation, whereas a combination design pattern COM 2 which shows figure of a cat is obtained from combination of basic unit design patterns (65), (66), (75) and (76) in FIG. 1. A combination design pattern COM 3 is obtained from a basic unit design pattern (47) and its rotations. A combination design pattern COM 4 is obtained from basic unit design patterns (53), (54) and their rotations. Thus many combination design patterns are obtained from basic unit design patterns shown in FIG. 1 as shown in FIG. 2. By increasing read out programs further, additional combinations of design patterns are available.

Preferably the combination design patterns and their codes are denoted on index cards or a book. The operator selects a combination design pattern on the cards or book and operates keys to provide electronic control system with the code which indicates the combination design pattern selected. According to the present invention, the home knitting machine is provided with display device for confirmation of the code supplied to the electronic control system. The operator operates keys, as she does with a pocket computor, to supply the code and confirm whether input is correct or not.

Knitting will be discontinued occasionally. After discontinuation, operator must begin to knit considering course No. of a fabric, design pattern No. and course No. of the design pattern of the preceding knitting operation before the discontinuation. Therefore it is preferable to memorize the preceding knitting course No., design pattern No. and course No. of the design pattern and read out them at begining of succeeding knitting operation so as to control read out of pattern informations in series with preceding knitting informations. Therefore in a preferred embodiment of the present invention, the home knitting machine is further provided with a semiconductor read and write memory device of static memory type i.e. nondestructive type. The read and write memory device, after memorization of the informations, continues to have the information even if the main power source of the home knitting machine were interrupted. Thus the operator may recall preceding course No., design pattern No. and course of the design pattern and set the knitting machine to operate from the course Nos. of the fabric and design pattern.

BRIEF DESCRIPTION OF THE DRAWINGS

FIG. 22 shows codes of keys;

DESCRIPTION OF THE EMBODIMENTS

Figure 1:
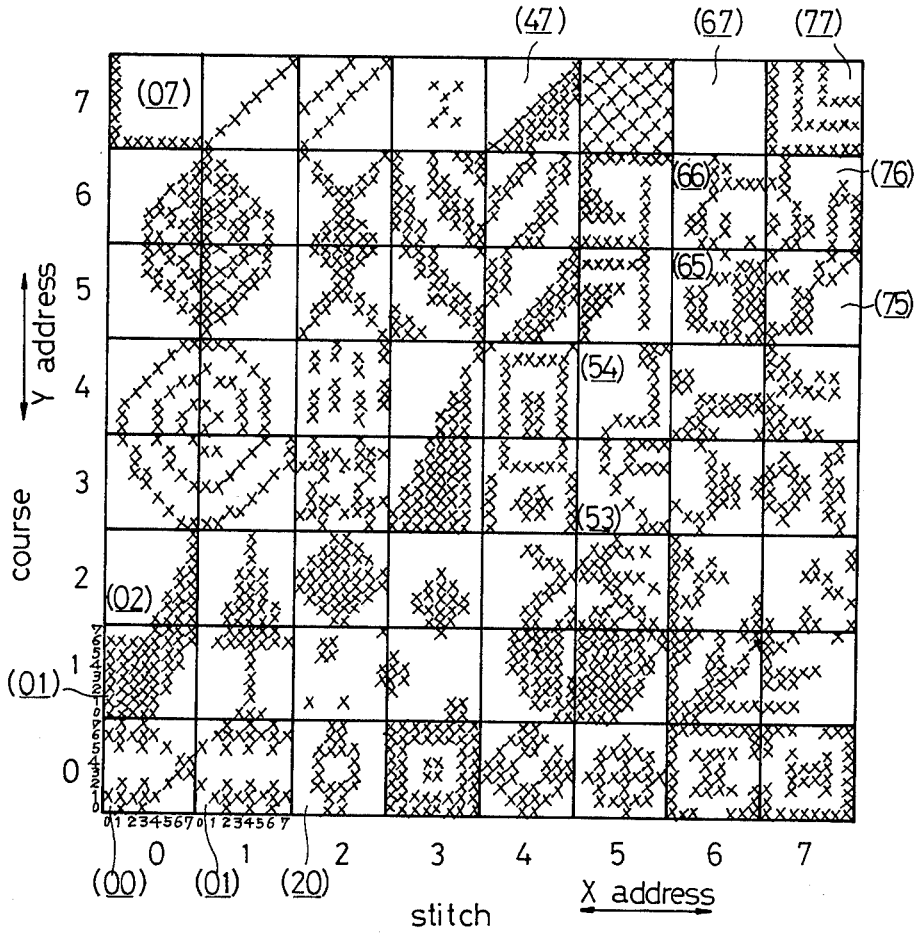
FIG. 1 shows in a viewable form fixed memory informations on the semiconductor read only memory device of the present invention.
Figure 3:
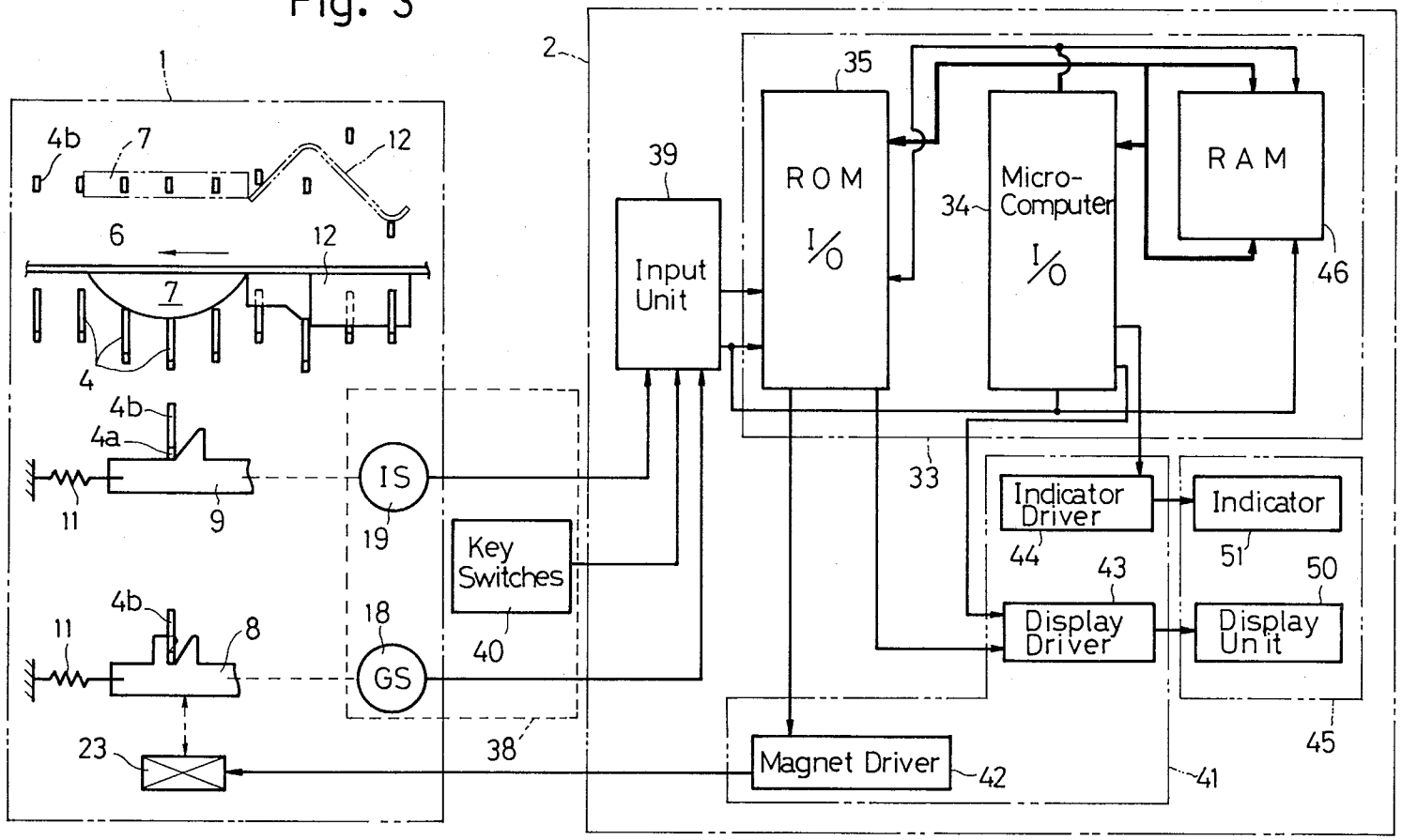
FIG. 3 is a block diagram showing main components of home knitting machine of an embodiment of the invention and their interrelation.

Referring to FIG. 3 of the drawings, reference characters 1 and 2 designate needle selector mechanism and electrical portion respectively of the home knitting machine of the invention. 38 Designates switch circuit. Directional fine solid lines in FIG. 3 show flow of electric signals, whereas directional heavy lines are data buses. Needle selector mechanism 1 operates switches 18 and 19 during movement (shown by an arrow) of the carriage 6 on needle bed in correspondance with depression of needles 4. Signals indicating needle No. depressed are supplied to input circuit 39 of the electric part 2 by the operation of switches 18 and 19. Also needle selector mechanism 1, in response to magnet energization signals from the electric part 2, selects needles to knit design patterns. This selection is in the form of holding the needles at depressed position. Thus, needle selector mechanism 1 provides electric part 2 with needle No. under depression cam 7 of the carriage 6, i.e. carriage position address, whereas electric part 2 provide needle selector mechanism 1 with needle selection signal. In response to operation of keys in key switch circuit 40, control mode command signal and code signal indicating design pattern knitting program are supplied to electric part 2. Input circuit 39 converts the signals from key switch circuit 40 into specific codes for electronic circuit. Read only memory device (hereinafter ROM) 35 in electric part 2 has fixed instructions of basic unit design patterns as shown in FIG. 1 and the design pattern knitting programs. Micro-computer 34 is supplied as the central control unit in electric part 2. Electric part 2 further comprises read and write memory device 46 (hereinafter RAM) of static memory (i.e. nonvolatile) type, indicator driver circuit 44 for energizing indicator lamps 51 for control input display, display driver circuit 43 for energizing display unit 50 for design pattern code indication, and magnet driver circuit 42 for energizing electrical magnets 23 in needle selector mechanism.

When operator operates keys in key switch circuit 40 to supply operation mode instructions for the knitting machine such as knitting mode or position of design patterns, the instructions are memorized on RAM in micro-computor 34 or, in case when the RAM overflows, on RAM 46 out of micro-computor 34, and displayed on indicator lamps 51. In response to operator's input operation of design pattern knitting program code, micro-computor 34 reads out the program and memorizes it on RAM in micro-computor 34 or, in case when the RAM overflows, on RAM 46. The program code is displayed on display unit 50. Then the operator drives the carriage 6 to move on needle bed. During traversing movement, carriage position signals as well as a signal indicating direction of the movement are supplied to micro-computor 34. And also a pulse is supplied to micro-computor 34 during one traversing movement of the carriage 6. Micro-computor 34 referring the signals with respect to the design pattern knitting program on RAM in it or RAM 46, reads out needle selecting informations (knitting instructions) sequentially from ROM 35 and supplies them to magnet driver circuit 42. The needle selector mechanism 1 selects needles in response to energization of electric magnets 23. When operator operates one or more key in the circuit 40 to discontinue knitting, the program code, final course No. of the fabric knitted, final course No. of the design pattern specified by the program code, and right and left side edge needle Nos. of the fabric if necessary are memorized on RAM 46. Thus, the RAM 46 memorizes the keyed-in data, e.g., knitting mode design pattern positions and also fabrication data, e.g., knitting programs, program code, final course No. of fabric knitted, etc. Then main power source excluding memory back-up power source for RAM 46 is interrupted. Upon operating keys in the circuit 40 and supplying continuation signal, micro-computor 34 reads out the data from RAM 46 and supplies them to circuits 42 through 44. Thereafter micro-computor 34 supplies out control signals and needle selecting signals in response to traversing movement of the carriage 6 sequentially to continue knitting of design pattern of the fabric precedingly discontinued.

Each elements shown in FIG. 3 are described hereinafter in more detail. The electric part 2 is mainly constructed with a micro-computor system 33, so that operation of the electric part 2 will be described referring to flow diagrams for easy understanding.

Figure 4:
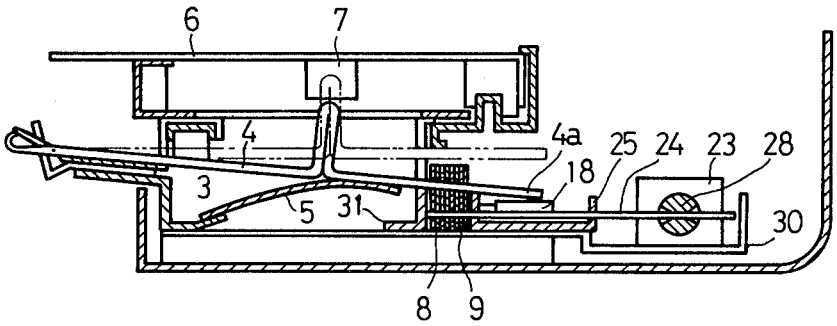
FIG. 4 shows cross-sectional view of a home knitting machine to which the present invention is applied.
Figure 5:
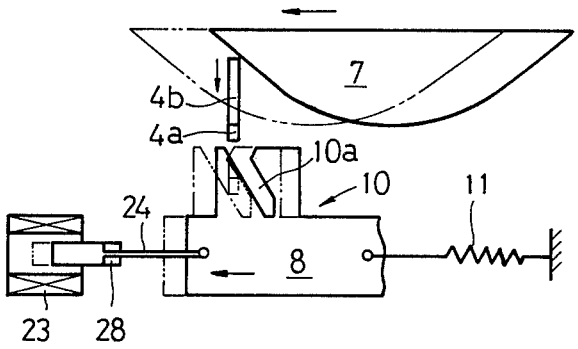
FIG. 5 and FIG. 6 show a side view of a depression cam 7 of the carriage 6 shown in FIG. 4.
Figure 6:
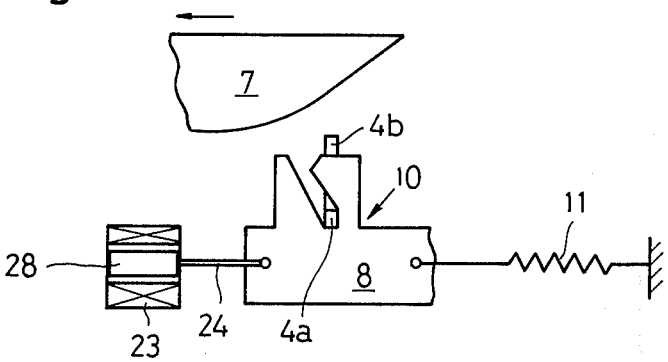
Figure 7A:
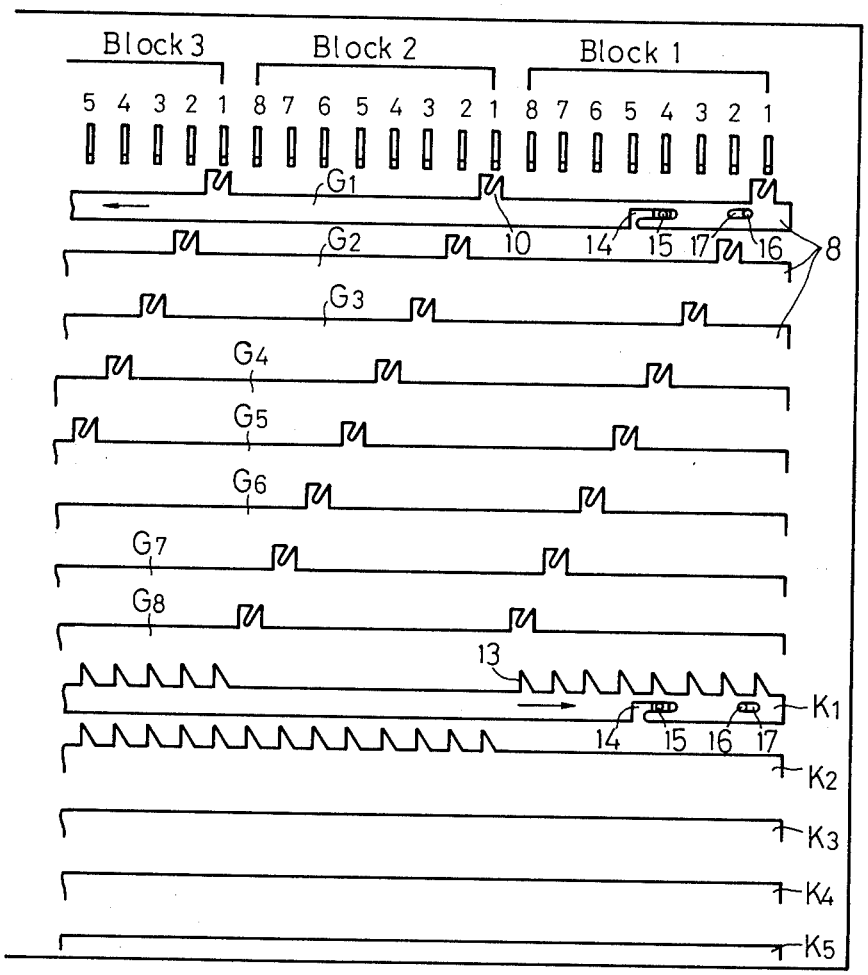
FIG. 7*a* is a pictorial disassembled side diagram of carriage position detector plates of first and second groups.
Figure 7B:
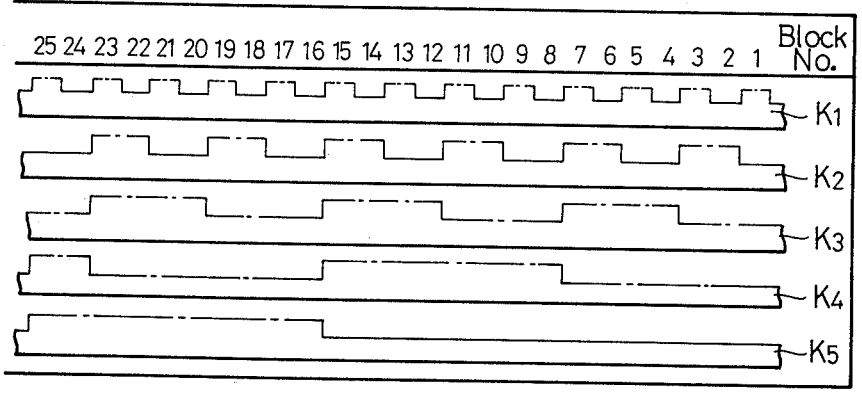
FIG. 7*b* is a reduced pictorial disassembled side view of carriage position detector plates of the second group.
Figure 8:
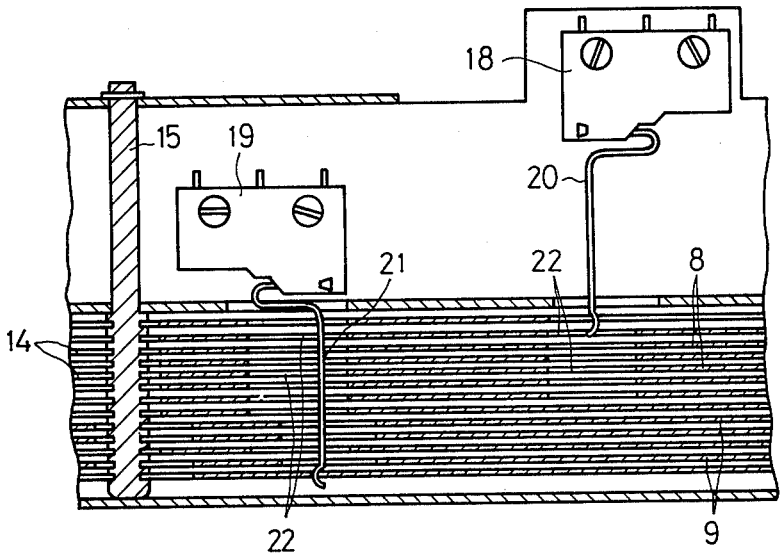
FIG. 8 and FIG. 9 show partial plan view of the carriage position detector plates of the first and second groups.
Figure 9:
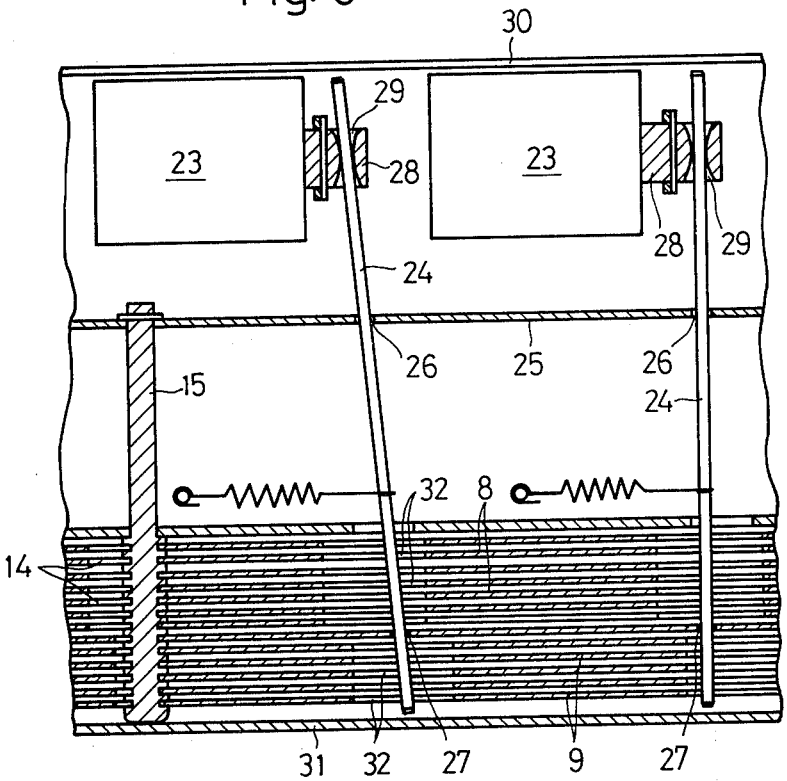

At first mechanical construction of a home knitting machine to which the present invention applied is described referring to FIG. 4 through FIG. 9. In FIG. 4, a plurality of needles 4 are arranged under the needle bed. The needles 4 are arranged in parallel and perpendicular to the longitudinal axis (which is vertical to the drawing) of the needle bed and are movable upward and along their respective longitudinal axes direction of them. The needles 4 are normally enforced to rise up by leaf springs 5. The rised positions (high bat state) of the needles 4 are shown by a phantom line in FIG. 4. There are provided the carriage 6 with depression cam 7 which depresses successively a bat portion 4*b* of each needle 4 at fabric knitting position during the traversing movement (along the longitudinal axis of the needle bed) of the carriage 6. There are provided a plurality of carriage position detector plates 8 (G1–G8) and 9 (K1–K5) under the needle bed as shown in FIG. 8 and FIG. 9. The carriage position detector plates 8 (G1–G8) and 9 (K1–K5) cross the needles 2 and are movable along the longitudinal axis of the needle bed. Holder rods 15 in long and narrow openings 14 of the plates guide the movement of the plates. Each plate G1–G8 and K1–K5 has cam portions 10 and 13 as shown in FIGS. 5 through 7*a*. Depression of a needle by the cam 7 of the carriage 6 causes movement of a plate of first group 8 (G1–G8) and a plate of second group 9 (K1–K5) against spring 11. For example, when a needle No. 1 of block No. 1 (FIG. 7*a*) is depressed by the cam 7, a plate G1 and a plate K1 move toward right and left respectively because the needle rod 4*a* touches with and depresses the cam portions 10 and 13 of the plates G1 and K1. Thus needle numbers depressed by the cam 7 i.e. carriage position are detected by detecting movements of the plates G1–G8 and K1–K5. To detect the movements of the plates, there are provided sensor switches 18 (GS1–GS8) and 19 (KS1–KS5) on the holder plate 30 along the longitudinal axis of the plates G1–G8 and K1–K5. Each of the switches 18 (GS1–GS8) and 19 (KS1–KS5) is operated by each of the plates G1–G8 and K1–K5 respectively. Every switches 18 (GS1–GS8) and 19 (KS1–KS5) has an actuator lever 20 (GL1–GL8) and 21 (KL1–KL5) respectively, each of which engages with a small opening 17 (GH1–GH8, KH1–KH5) of a plate G1–G8, K1–K5 through long and narrow openings 22 of the other plates G1–G8, K1–K5 so as to be operate by one of the plates G1–G8 and K1–K5. As shown in FIG. 7*a* and FIG. 7*b*, every plate G1–G8 of the first group has a cam portion 10 in every needle block whereas every plate K1–K5 of the second group has a plurality of cam portions 13 in a needle block with the cam portions 13 being arranged so that movement of the switch plates K1–K5 will provide a binary coded indication of the particular block in which the depressed needle is located. Thus operation of every switch GS1–GS8 of the first switch group 18 indicates depressed needle No. in every needle block, and operations of one or more switches K1–K5 of the second switch group 19 indicate a block No. in which depressed needle is included. The indication of needle Nos. in a block by the switches 18 (GS1–GS8) is a single relation between needles and the switches, whereas the indication of block Nos. in all needles array by the switches 19 (K1–K5) is binary-coded decimal notation. Depressed needle Nos. i.e. carriage positions are thus indicated with the needle Nos. in a block and the block Nos. in the all needles array. Needle Nos. thus obtained are transmitted to micro-computor system 33 as carriage position indication signals, which are employed for fabric knitting control and color pattern knitting control in the system 33.

The needles 4, after depression by the depression cam 7, normally enforced to move upward by leaf springs 5. However needles 4 are held at depressed position after depression of needles and energization of electric magnets 23 as shown in FIG. 6. Because the magnets 23 drive plungers 28 which are connected with the plates G1–G8 through linkages 24 toward left, cam throats 10*a* of cam portions 10 hold tails 4*a* of needles 4.

Needles thus held in depressed position are separated from undepressed needles during traversing movement of carriage 6 with separator 12 as shown in FIG. 3. In this case, number of needles 4 are 200 and each of the first carriage position detector plates 8 has 25 cam portions 10, whereas each of the second carriage position detector plates 9 has 100 cam portions. As shown in FIG. 7*a*, tapers of cam portions 13 of the second carriage position detector plates 9 are reversed direction as compared with that of the first carriage position detector plates 10. Therefore the first and second plates 8 and 9 move opposite direction when tail 4*a* of needles 4 depresses taper cam portion of the plates 8 and 9. When magnets 23 are energized by selection signal selected, plates 8 of the first group are held at slided position against springs 11 as shown in FIG. 6. The selection signal, which correspond to design pattern instruction shown in FIG. 1, is supplied out from electric part 2 in response to carriage position. Depressed and held needles by the cam portions 10 are separated from unheld needles by separator 12 as shown in FIG. 3 in accordance with traversing movement of carriage 6. Design pattern fabric stitches are constructed in a well-known manner with the needles thus separated by separator 12 during passage of the needles by the fabric knitting cam mechanism (not shown) of carriage 6.

Referring again to FIG. 3, micro-computor 34 in electronic center control circuit 33 is a main part of electric part 2 and generates control command signals. Programes which determine control operations of computor 34 are preliminary memorized on ROM 35 as fixed memory. RAM 46 memorizes data for computation, result of computation, input data and etc. in response to instructions from computor 34. So called micro-computor system is constructed with the micro-computor 34, ROM 35, RAM 46 and input circuit. Input to micro-computor 34 is obtained from input circuit 39 which converts electric signals from switch circuit 38 into code signals suitable for electronic processing in the system 33. Switch circuit 38 includes sensor switches of first group 18 (GS1–GS8) and second group 19 (KS1–KS5) as well as key switches 40. Switches included in circuit 38 may be those of magnetic type, photo-sensor type or mechanical contacts type. In the embodiment hereinafter described, switches of mechanical contacts type are employed. Key switches 40 are connected with input circuit 39 and provide micro-computor 34 with input data through the circuit 39. Needle selection data are supplied to magnet driver circuit 42 from ROM 35 through output port of ROM 35 in response to instructions from microcomputor 34. Display data from micro-computor 34 are supplied to display driver circut 43. Also indication data from microcomputor 34 are supplied to indicator driver circuit 44. Basic unit design pattern instructions (FIG. 1) as well as read out program and operation control programs are preliminary memorized on ROM 35. Memory of the programs may be employed for the basic unit design pattern instructions. Display device 45 may be any of well know display devices. In the embodiment hereinafter described, light emitting diode display unit 50 is employed. Indicator 51 includes lamps and light emitting diode.

Figure 10:
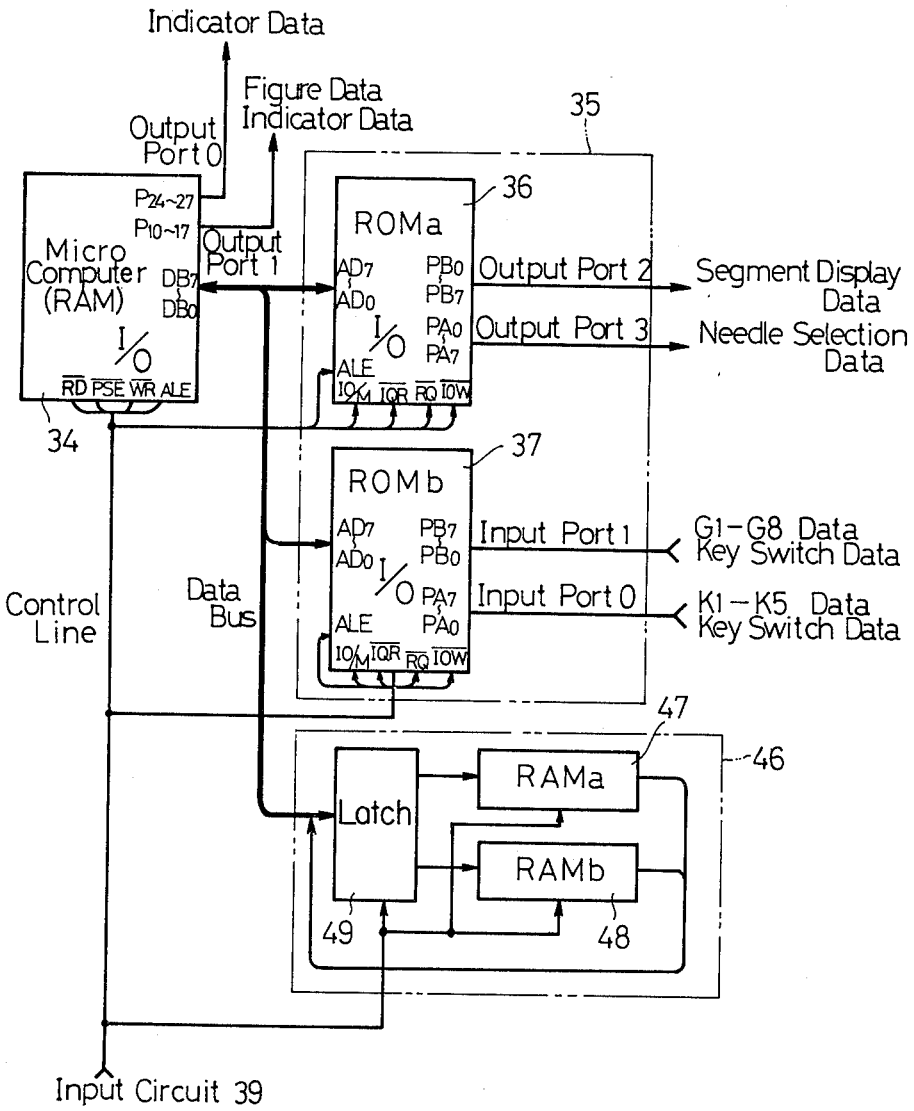
FIG. 10 is a block diagram showing electronic components of the micro-computor system 33 shown in FIG. 3.
Figure 11:
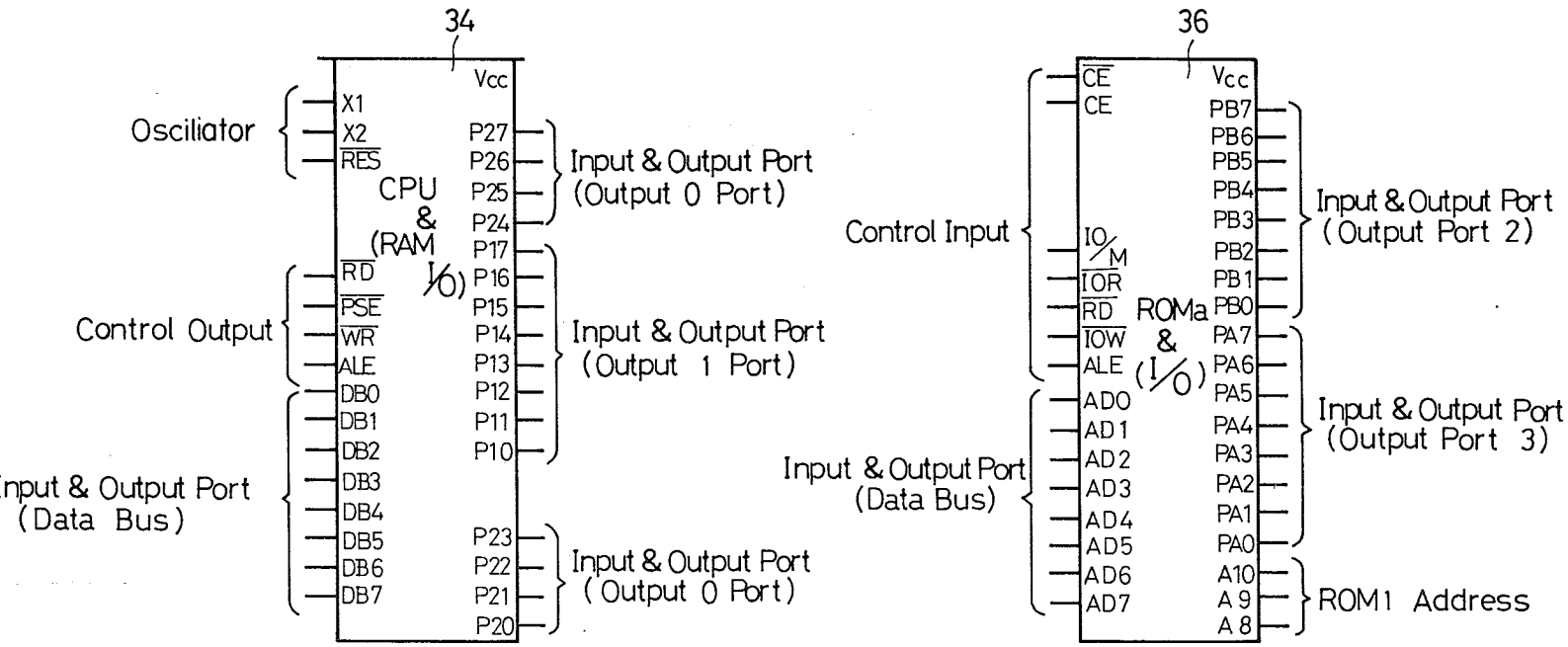
FIG. 11 shows terminals of a central processing unit and read only memory in the micro-computor system 33 shown in FIG. 3.

Basic construction and functions of electronic center control circuit 33 are described hereinafter referring to FIG. 10 and FIG. 11. Referring to FIG. 10, RAM 46 has fixed memory, 8 bits of which construct a word. Lower 4 bits of a data word are memorized on RAM chip (RAM a) 47 and upper 4 bits of a data word are memorized on RAM chip (RAM b) 48. Latch 49 in the RAM device 46 hold read out address data. Micro-computor 34 shown in FIG. 10 and FIG. 11 is a large scale integrated circuit (LSI) chip and has a RAM of 64 bytes. The computor 34 processes 8 bits parallely. In this case one byte includes 8 bits. The micro-computor chip 34 also has 27 input and output ports $DB_0$–$DB_7$, $P_{20}$–$P_{27}$, $P_{10}$–$P_{17}$ and output terminals $\overline{RD}$, $\overline{PSE}$, ALE, $\overline{WR}$. The output terminals $\overline{RD}$ and $\overline{PSE}$ supply read and write control signals for reading data from RAM 46, ROM 35 and writing data of RAM 46, respectively. Output terminal ALE supplies out address latch signal to external memory devices 35, 46. Output terminal $\overline{WR}$ supplies out write indication signal to external memory devices 35, 46. Data busses connected with the terminals $DB_0$–$DB_7$ are utilized for input and output data transmission and also for address data transmission. The terminals $P_{20}$–$P_{23}$ are utilized for output port O and for address data output for 3 bits from upper 9 bit to 12 bit of ROMa 36 and ROM 37. The terminal $P_{20}$–$P_{23}$ supplies out signals which appoint RAM 46 and input or output of I/O ports of ROMa 36 and ROMb 37. Oscilator circuit is connected with terminals $X_1$, $X_2$ and $\overline{RES}$. The micro-computor 34 includes accumulation logic unit, accumulator, time counter, program counter, flag register, general use register, data register, instruction register, decorder, level tucker, control circuit and timing circuit.

ROMa 36 is a large scale integrated circuit (LS1) chip and constructs a part of micro-computor system 33 and has programes for the system. ROMa36 has programable I/O ports $AD_0$–$AD_7$ (data busses), $PA_0$–$PA_7$, $PB_0$–$PB_7$. Also ROMa36 has input terminals IO/M, $\overline{IOR}$, $\overline{IOW}$, ALE, $\overline{RD}$, CE and $\overline{CE}$. IO/M receives output or input indication signal to decide I/O mode of the ROMa36. $\overline{IOR}$ receives read out control signal and ALE receives address appointment signal. Signals which indicate appointment of ROMa36 are supplied to CE or $\overline{CE}$. $\overline{RD}$ receives program command data read out control signal. Input terminals $A_8$–$A_{10}$ receives 3 bits from upper 9 bit to 12 bit of address data for ROMb37. Construction and operation of ROMb37 is the same with those of ROMa36.

Micro-computor 34, receiving input data from output port of ROM35 through input port of the computor 34, operates in accordance with stored programes on ROM35. Data from ROM35 and data obtained from operation of computor 34 are memorized in an internal RAM of micro-computer 34 and/or external RAM46. Data obtained from operation of computer 34 are supplied out through output port of computor 34. In the embodiment shown in FIG. 10, terminals $PA_0$–$PA_7$ of ROMb37 are assumed to be input port 0 which receives 8 bits as index data and key in data. Terminals $PA_0$–$PA_7$ of ROMa36 are assumed to be output port 3 which supplies out 8 bits of needle selection signals (FIG. 1) for energizing magnet driver circuit 42. Terminal $PB_0$–$PB_7$ of ROMa36 are assumed to be output port 2 which supplies 8 bits for segments display data which energize display driver circuit 43. $P_{10}$–$P_{17}$ of micro-computor 34 are assumed to be output port 1 which supplies out 8 bits, upper 6 bits ($P_{10}$–$P_{15}$) of which are supplied to indicator driver circuit 44. $P_{20}$–$P_{27}$ of micro-computor 34 are assumed to be output port 0 which supplies out 8 bits, lower 4 bits ($P_{20}$–$P_{23}$) of which are control signals. Upper 4 bits ($P_{24}$–$P_{27}$) are supplied to display driver circuit 43 as figure (order) indication data. Operation timing of microcomputer 34 is shown in FIG. 12.

Figure 12:
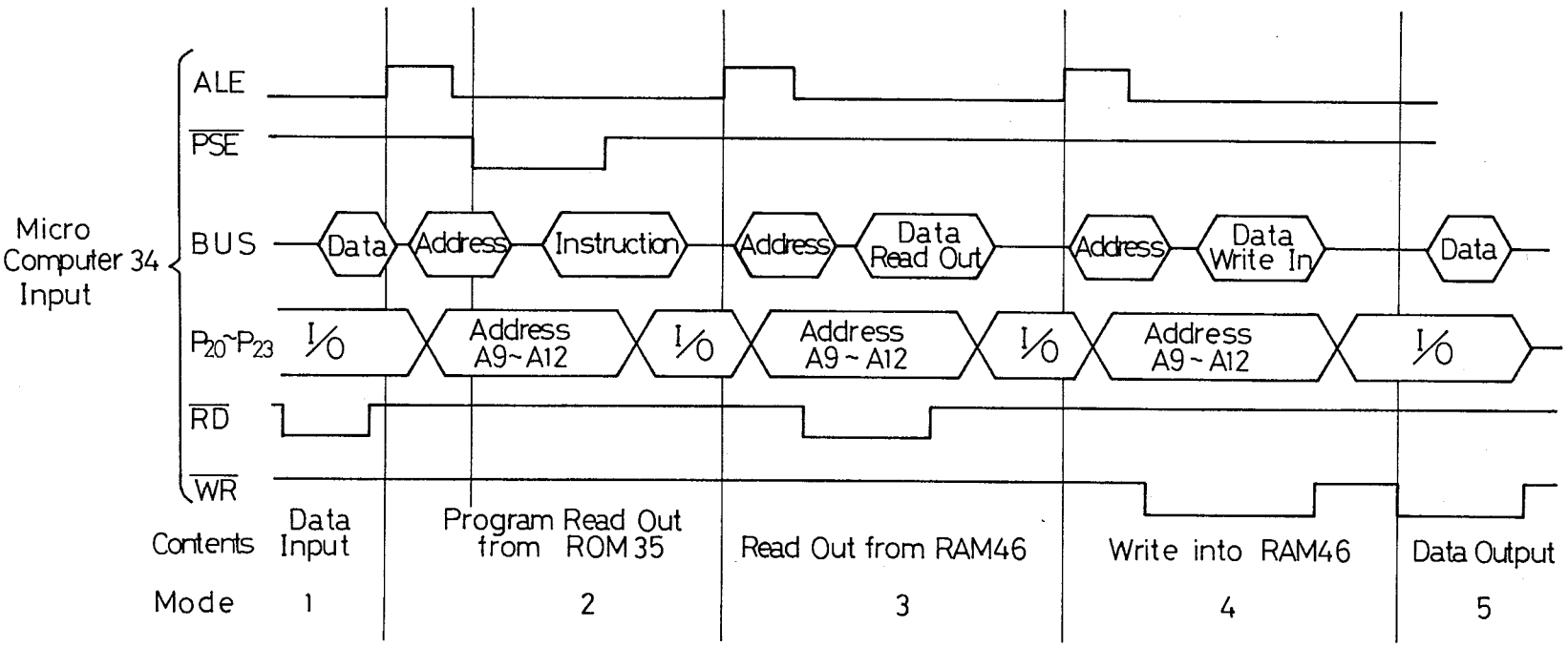
FIG. 12 is a timing chart showing input and output timing of the micro-computer system 33.
Figure 13:
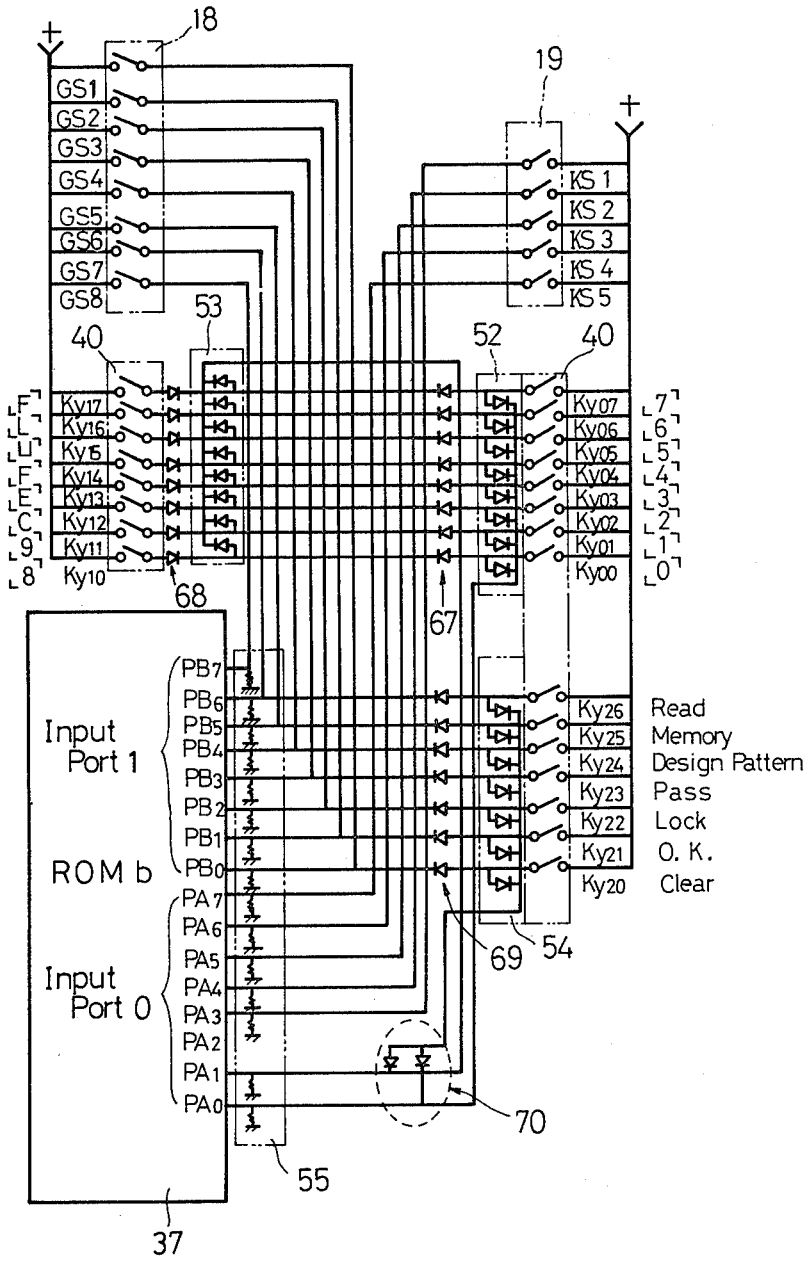
FIG. 13 is a circuit diagram showing key switch circuit 40 shown in FIG. 3.

Referring to FIG. 12, input port 0 or 1 is selected by input data of terminals $P_{20}$–$P_{23}$, and input data at input port 0 or 1 of ROMb37 are introduced in micro-computer 34 in response to read out indication input at $\overline{RD}$ (mode 1 in FIG. 12). Mode 2 is program read mode, in which 8 bits of $AD_0$–$AD_7$ are appointed on data busses and upper 4 bits of them are introduced into latch in ROM36 in response to data at $P_{20}$–$P_{23}$ to appoint read out address of ROM36 with address latch ALE, then 8 bits data of ROM36 are read out as command code of micro-computor 34. Mode 3 is read out mode of external RAM46, in which address appointment is the same with mode 2, however, read out signal is $\overline{RD}$ which indicates read out of RAM46. Mode 4 is write in mode of data obtained from micro-computor 34 into external RAM46, in which address appointment is the same with mode 2, however, write in signal is $\overline{WR}$ which indicates write in of RAM46. Mode 5 is output mode in which micro-computor 34 supplies out data in response to $\overline{WR}$. Those basic modes 1–5 are indicated by 8 bits code in micro-computor 34 and each command is constructed with one byte (8 bits) or two bytes (16 bits). Computor system 33 operates in response to command code constructed with combination of the bytes which indicate the basic modes. Elements in computor 34 such as accumulator and registers operates in response to the command code, Referring FIG. 13 which shows switch circuit 38 and input circuit 40, sensor switches of first group 18 (GS1–GS8) and second group 19 (KS1–KS5) are respectively connected with input port 1 and 0 of ROMb37. When the depression cam 7 depresses a needle of No. 1 in block No. 2, sensor switches GS1 of first group 18 and KS2 of second group 19 are closed. Then signal code "00010000" is supplied to input port 0 of ROMb37 and "00000001" is supplied to input port 1 of ROMb37. Micro-computor 34 introduces the codes into internal registers and detects depression of a needle and position of the needle. Key switches 40 includes push button key switches $K_{y00}$–$K_{y07}$, $K_{y10}$–$K_{y17}$ and $K_{y20}$–$K_{y26}$. Each of key switches $K_{y00}$–$K_{y07}$ corresponds numerals "0", "1", "2", . . . , and "7" respectively. Each of key switches $K_{y10}$–$K_{y17}$ corresponds to numerals and letters "8", "9", "C", "F", "H", "L" and "R" respectively. Key switches $K_{y20}$–$K_{y25}$ corresponds letters "Clear", "OK", "Lock", "Pass", "Design", "Memory" and "Read" respectively. Key switches $K_{y00}$–$k_{y26}$ are connected with input port 1 of ROMb37. Diodes 67 are connected between key switches $K_{y00}$–$K_{y07}$ and input port 1. Diodes 68 are connected between key switches $K_{y10}$–$K_{y17}$ and input port 1. Diodes 69 are connected between key switches $K_{y20}$–$K_{y26}$ and input port 1. Anode of diodes 52, 53 and 54 are connected respectively with key switches $K_{y00}$–$K_{y07}$, $K_{y10}$–$K_{y17}$ and $K_{y20}$–$K_{y26}$. Cathode of diodes 52, 53 and 54 are connected with terminals PA0 and PA1 of input port O. Resistors array 55 is connected with input port 0 and 1 of ROMb37. In this combination, when "Design" key switch $K_{y24}$ is closed, input data code of input port 0 and 1 are respectively "00000100" and "00010000" which are supplied to micro-computor 34. After operation of micro-computor 34 in response to the codes, micro-computor 34 waits for input of design No. which indicates a design pattern knitting program. Operator operates one or more key switches of the key switches $K_{y00}$–$K_{y07}$, $K_{y10}$–$K_{y17}$ to provide micro-computor 34 with design No. which corresponds to design pattern to be knitted in a fabric.

Figure 2:
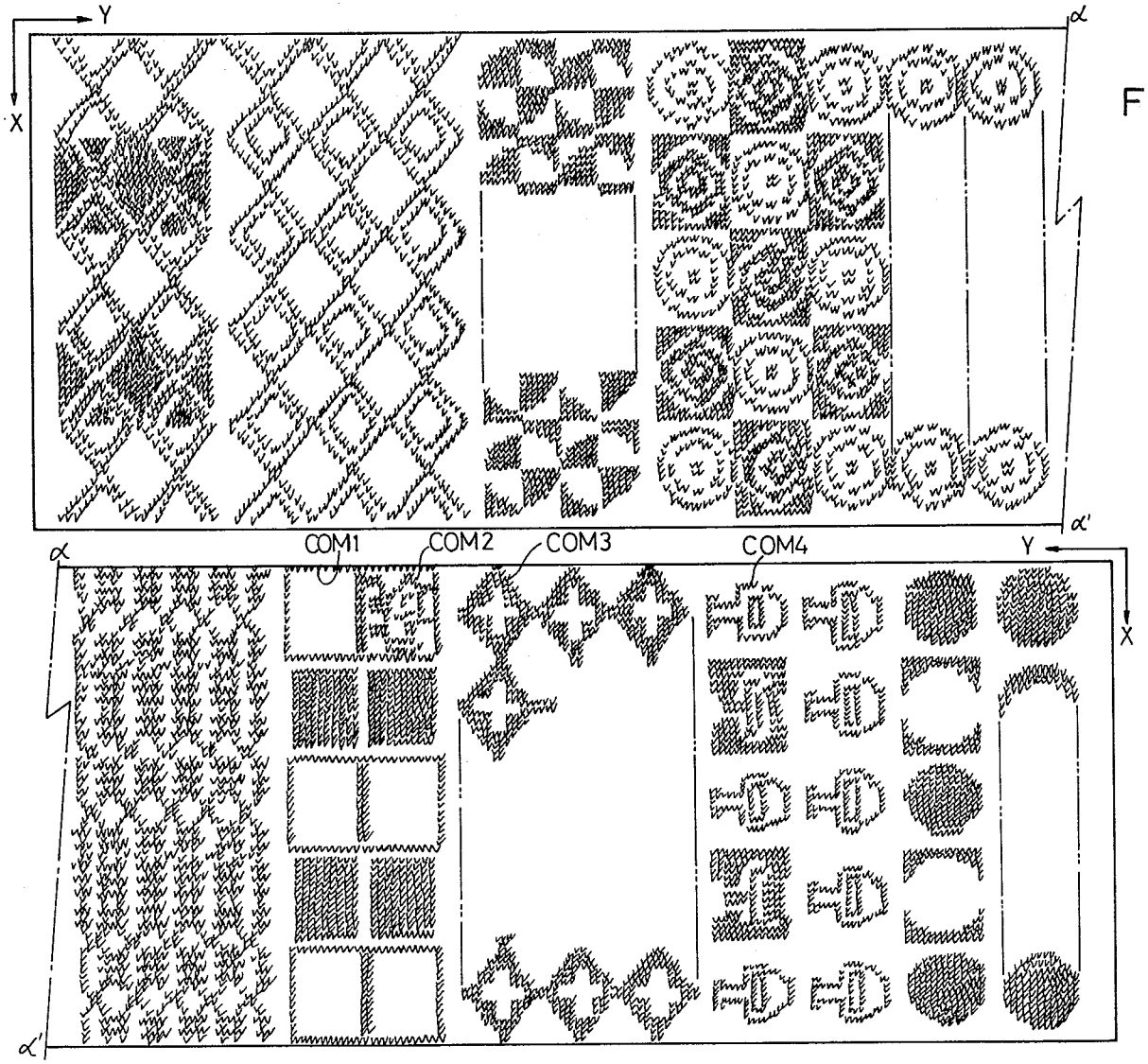
FIG. 2 shows some combination design patterns which can be constructed with the basic unit design informations shown in FIG. 1.
Figure 14:
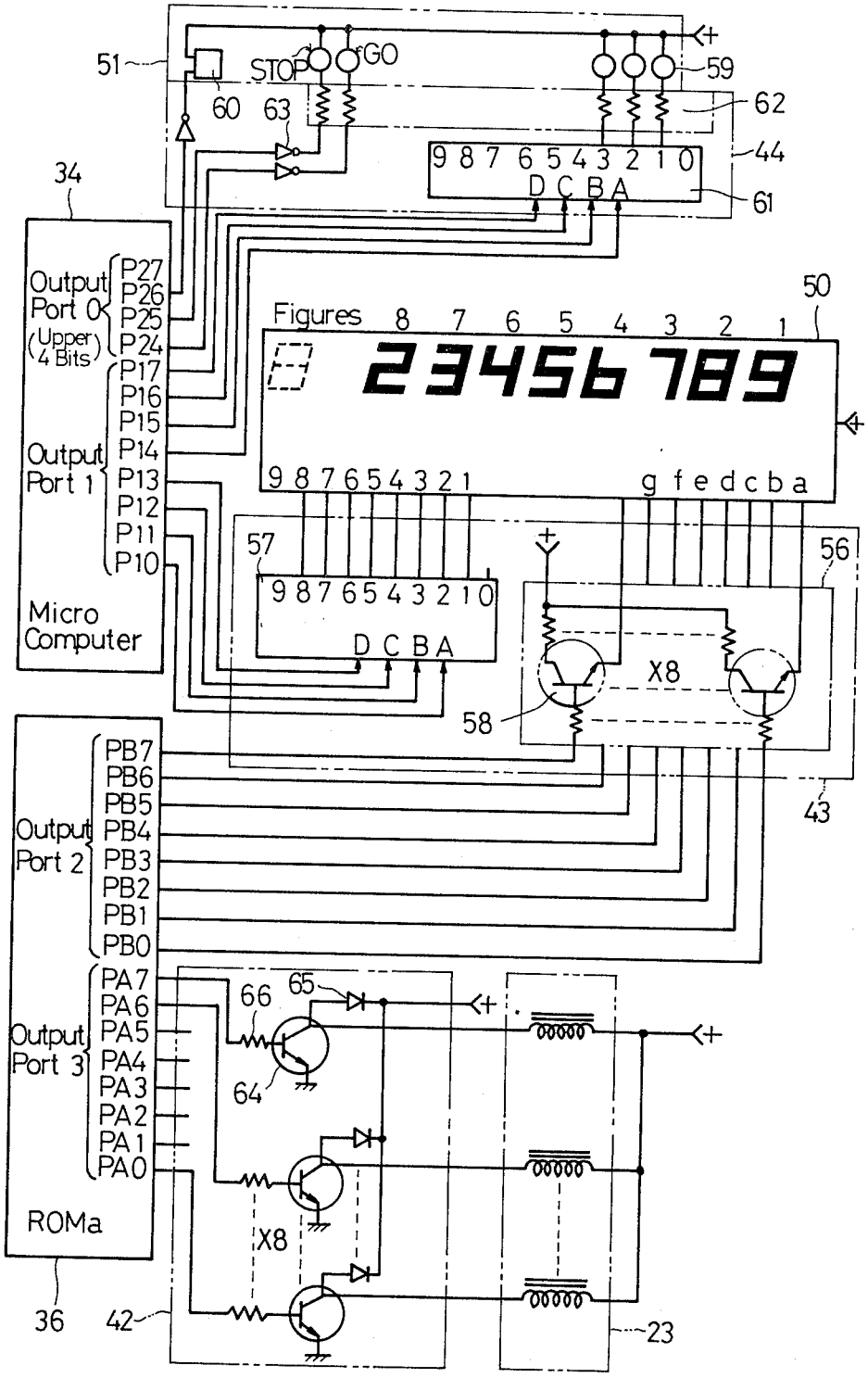
FIG. 14 is a circuit diagram showing output circuit 41 and display device 45 shown in FIG. 3.
Figure 15:
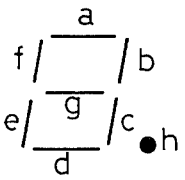
FIG. 15 shows display characters of display unit 45.

FIG. 14 shows output circuit 41 and display device 45, in which display unit 50 is a 7 segments and 9 figure display. In this case upper most FIG. 9 is not designed to energize. Display driver circuit 43 is of dynamic energization type. Namely the circuit 43 energizes each figure and each segment in time sharing mode. This time sharing is controlled by micro-computor 34. Figure code is supplied out in the form of 4 bits from P10-P13 of output port 1 of micro-computor 34. Segment code is supplied out from PB0-PB7 of output port 2 of ROMa36. 4 bits figure data from P10-P13 of output port 1 of micro-computor 34 is decoded in figure driver circuit 57 to generates figure signals 1–9. The segment code energizes transistor 58 in segment driver circuit 56 to generate segment signals a–g. Figure code "0010" at P10–P13 appoints FIG. 2 and segement code "01111111" appoints numeral "8", in which case numeral "8" is appeared on FIG. 2 of display unit 50. Relationship between segment data and corresponding display numerals or letters are shown in FIG. 15. Indicator 51 includes light emitting diodes to indicate operational condition of knitting machine and a buzzer to cause attention of operator. Output code of 4 bits from P14-P17 of output port 1 of micro-computor 34 is supplied to decorder 61 in indicator driver circuit 44. The decorder 61 energizes one of diodes 59 in response to input code A–D. For example one of the diodes 59 is energized to light when input code A–D is "0001" which indicates design pattern exchange. The diode designated by "GO" in FIG. 14 indicates that conditions are ready for knitting. The diode designated by "STOP" in FIG. 14 indicates input error. The buzzer 60 informs error of knitting. Those indication elements "GO" and "STOP" diodes and buzzer 60 are energized with upper 3 bits (indicator data: P24–P26) of output port 0 of micro-computor 34. For example, indicator data "100" energizes buzzer 60. Resistors array 62 limits current which flows into diodes 59. 8 bits data at output port 3 (PA0-PA7) of ROMa36 are supplied to magnet driver circuit 42 (refer to FIG. 14 again). Transistors 64 in driver circuit 42 are biased to turn ON with the data gfrom the output port 3 of ROMa36. Thus the transistors 64 control energization of electric magnets 23. Diodes 65 interrupt application of reversal voltage to the transistors 64. Resistors 66 limit current to base of the transistors 64.

Figure 16:
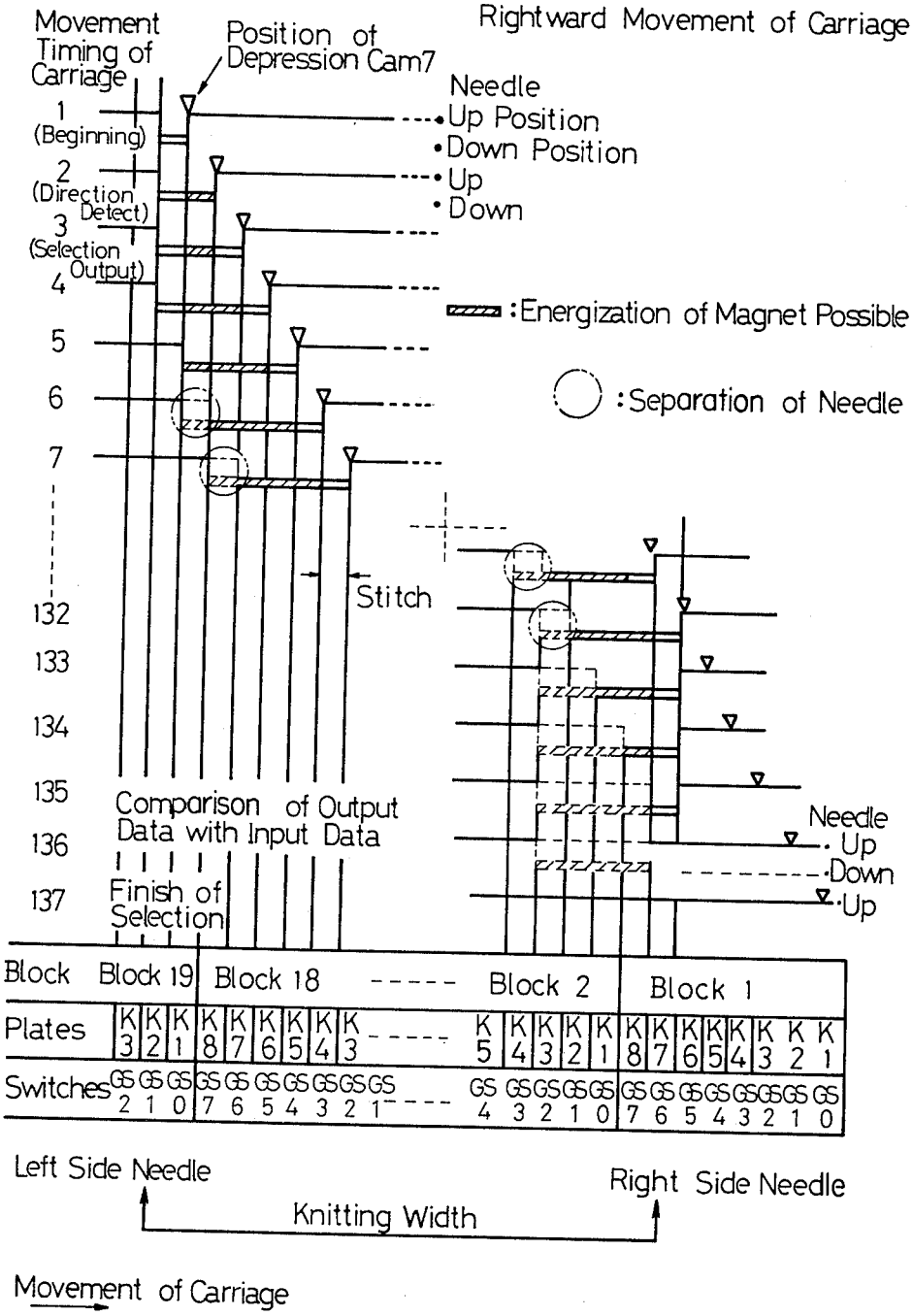
FIG. 16 is a timing chart showing needle selecting timing.

FIG. 16 shows timing of needle selection. Assuming that fabrication is between needle No. 2 in block No. 19 and needle No. 7 in block No. 1 and carriage 6 travels toward right, needle of No. 3 in block No. 19 is depressed by depression cam 7 at timing 1. Then needle of No. 2 in block No. 19 is depressed by depression cam 7 at timing 2. At this timing 2, micro-computor 34 detects traversing direction of carriage as "toward right" by comparing preceding depressed needle No. with succeeding depressed needle No. Thereafter the depression cam 7 depresses needle of No. 1 in block No. 19, needle of No. 8, 7, 6, . . . of block No. 18 in succession during traversing movement of carriage toward right. The depression cam 7 depresses 4 needles at the same time. Namely needle of No. 3 in block No. 19 is depressed until the depression cam 7 depresses needle of No. 7 in block No. 18. Sensor switches 18 (GS1–GS8) generates depression indication signals when the cam 7 depresses needles in succession. The micro-computor 34 detects needle No. and reads out needle selection signals corresponding to needle No. to energize electric magnets 23. When one of magnets 23 is energized, a cam portion 10 of a position detector plate (in G1–G8) engages with depressed needle. Thus needles which are appointed selection signals by micro-computor 34 are held at sinked halt position after passing of the depression cam 7. Needles which are not appointed selection signals are released upward after passing of the depression cam 7. Needles at sinked halt position are guided into design knitting position by cam mechanism of carriage. When depression cam 7 passes through final needle of No. 8 of block No. 1, micro-computor 34 detects finish of a course knitting at timing 136 by comparing needle No. code with selection signal output.

The embodiment shown and described hereinbefore requires programs for operating micro-computor 34. Therefore operation flow of the system shown in FIG. 3 is described hereinafter in accordance with operation program of micro-computor 34, wherein order or command in micro-computor system and specific words for micro-computor system as eliminated as much as possible for easy understanding.

Figure 17A:
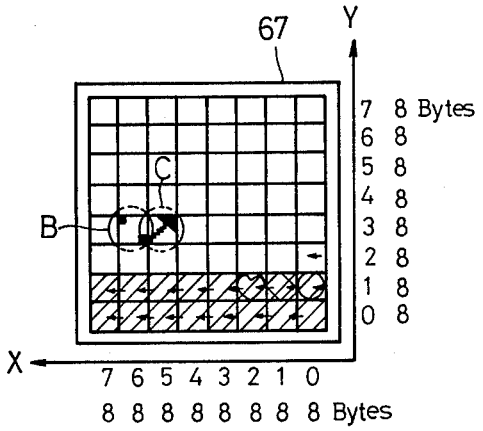
FIG. 17*a* shows an design pattern on a instruction book.

FIG. 17*a* shows a card in a instruction book. Basic unit design patterns are printed on a card 67. Image on the card 67 is such as shown in FIG. 1.

Figure 17B:
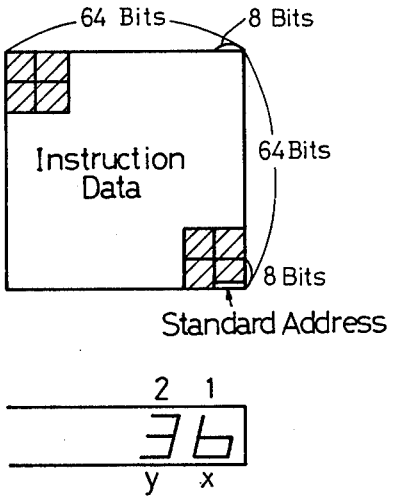
FIG. 17*b* and FIG. 17*c* respectively show a part of a design pattern on the instruction book in enlarged scale.
Figure 17C:
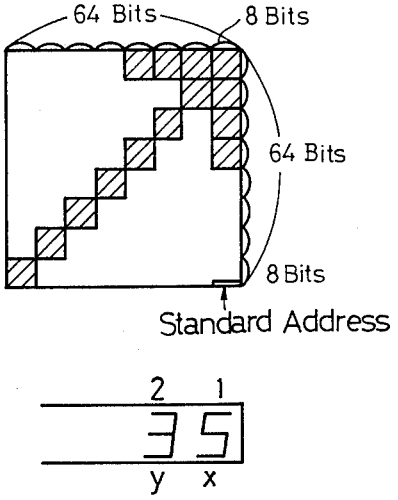

FIGS. 17*b* and 17*c* respectively shows enlarged partial view of B and C in FIG. 17*a*.

Figure 18:
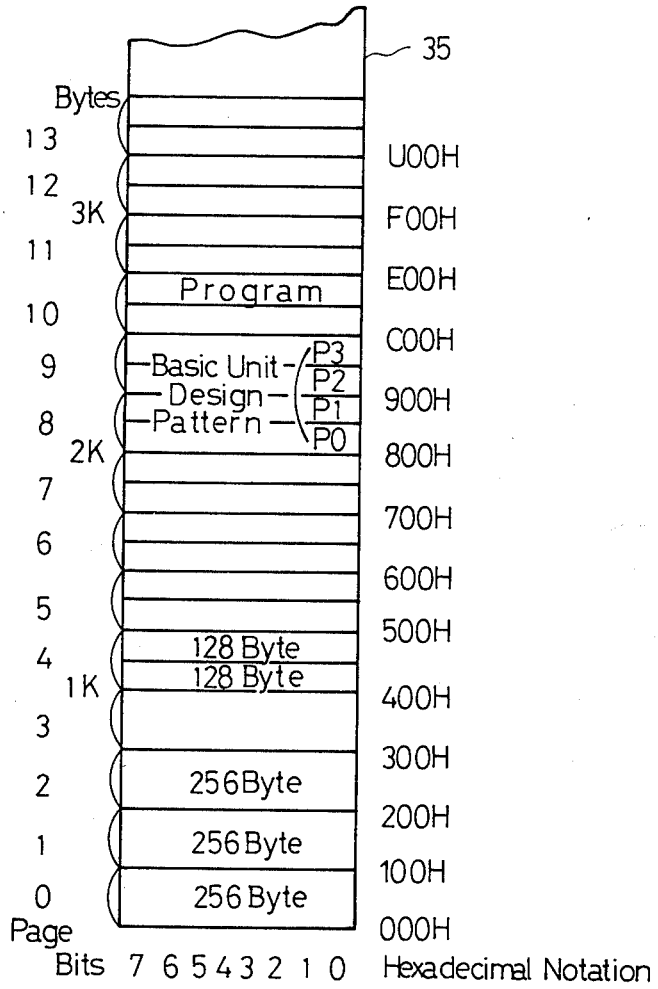
FIG. 18 shows data distribution on the semiconductor read only memory device 35.

FIG. 18 shows memory distribution (ROM Map) on ROM 35 which has pattern instructions corresponding to the basic unit design patterns on the card 67 as fixed memory. Memory area of the basic design patterns is from 2048 byte to 2525 byte in ROM 35.

Operation of the embodiment shown in FIG. 3 is described hereinafter referring to FIGS. 19 through 52. For easy understanding of flow charts, memory addresses are determined such as shown in following table 1 and table 2.

TABLE 1

| No. Decimal Notation | Address Hexa-decimal Notation | Name of Register | No. Decimal Notation | Address Hexa-decimal Notation | Name of Register |
|---|---|---|---|---|---|
| 0 | 00 | B | 24 | 18 | W |
| 1 | 01 | G | 25 | 19 | Y |
| 2 | 02 | J | 26 | 1C | X |
| 3 | 03 | K | 27 | 1E | Top |
| 4 | 04 | P | 28 | 1F | Last |
| 5 | 05 | Q | 29 | 1U | Selection |
| 6 | 06 | S | 30 | 1L | Index |
| 7 | 07 | V | 31 | 1R | G1-G8 |
| 8 | 08 | | 32 | 20 | Key |
| 9 | 09 | | 33 | 21 | Display 1 |
| 10 | 0C | | 34 | 22 | Display 2 |
| 11 | 0E | | 35 | 23 | Display 3 |
| 12 | 0F | | 36 | 24 | Display 4 |
| 13 | 0U | | 37 | 25 | Display 5 |
| 14 | 0L | | 38 | 26 | Design No. 1 |
| 15 | 0R | | 39 | 27 | Design No. 2 |
| 16 | 10 | | 40 | 28 | Design No. 3 |
| 17 | 11 | | 41 | 29 | Design No. 4 |
| 18 | 12 | | 42 | 2C | Design No. 5 |
| 19 | 13 | | 43 | 2E | Design Course |
| 20 | 14 | | 44 | 2F | Design Set |
| 21 | 15 | | 45 | 2U | Figure |

TABLE 1-continued

| No. Decimal Notation | Address Hexa-decimal Notation | Name of Register | No. Decimal Notation | Address Hexa-decimal Notation | Name of Register |
|---|---|---|---|---|---|
| 22 | 16 | | 46 | 2L | Segment Input |
| 23 | 17 | | 47 | 2R | Figure |

TABLE 2

| No. Decimal Notation | Address Hexa-decimal Notation | Name of Register | No. Decimal Notation | Address Hexa-decimal Notation | Name of Register |
|---|---|---|---|---|---|
| 48 | 30 | Direction | 72 | 08 | |
| 49 | 31 | Mark | 73 | 09 | |
| 50 | 32 | Control | 74 | 0C | |
| 51 | 33 | Control | 75 | 0E | |
| 52 | 34 | | 76 | 0F | |
| 53 | 35 | | 77 | 0U | |
| 54 | 36 | | 78 | 0L | |
| 55 | 37 | Select Design | 79 | 0R | |
| 56 | 38 | Address 0 Design | 80 | 10 | |
| 57 | 39 | Address 1 Design | 81 | 11 | Display 1 |
| 58 | 3C | Address 2 Design | 82 | 12 | Display 2 |
| 59 | 3E | Address 3 Design | 83 | 13 | Display 3 |
| 60 | 3F | Address 4 Design | 84 | 14 | Display 4 |
| 61 | 3U | Address 5 Design | 85 | 15 | Display 5 Design |
| 62 | 3L | Address 6 Design | 86 | 16 | No. 1 Design |
| 63 | 3R | Address 7 | 87 | 17 | No. 2 Design |
| 64 | 00 | Design 0 | 88 | 18 | No. 3 Design |
| 65 | 01 | Design 1 | 89 | 19 | No. 4 Design |
| 66 | 02 | Design 2 | 90 | 1C | No. 5 Design |
| 67 | 03 | Design 3 | 91 | 1E | Set Design |
| 68 | 04 | Design 4 | 92 | 1F | Course |
| 69 | 05 | Design 5 | 93 | 1U | |
| 70 | 06 | Design 6 | 94 | 1L | |
| 71 | 07 | Design 7 | 95 | 1R | |

In tables 1 and 2, No. 0 through 63 indicate address of internal RAM of micro-computor 34 as well as name of registers. Registers B, G, J, K, P, Q, S, V, W and Y are for general use and registers of Nos. 8 through 23 are for stack, i.e., they accumulate input data. Registers of Nos. 64 through 95 are in RAM 46 and appointed by address data to RAM 46. Registers of Nos. 64 through 71 are employed for storing designs 0 through 7 and memorize needle selection data. Hexadecimal code is employed for address code. Therefore 0 through 15 are indicated by 00H, 01H, . . . 08H, 0CH, 0EH, 0FH, 0UH, 0LH and 0AH respectively, wherein "H" indicates hexadecimal notation and E,F,U,L and A are display characters shown by display unit 50. (S) indicates data in S register.

Figure 19:
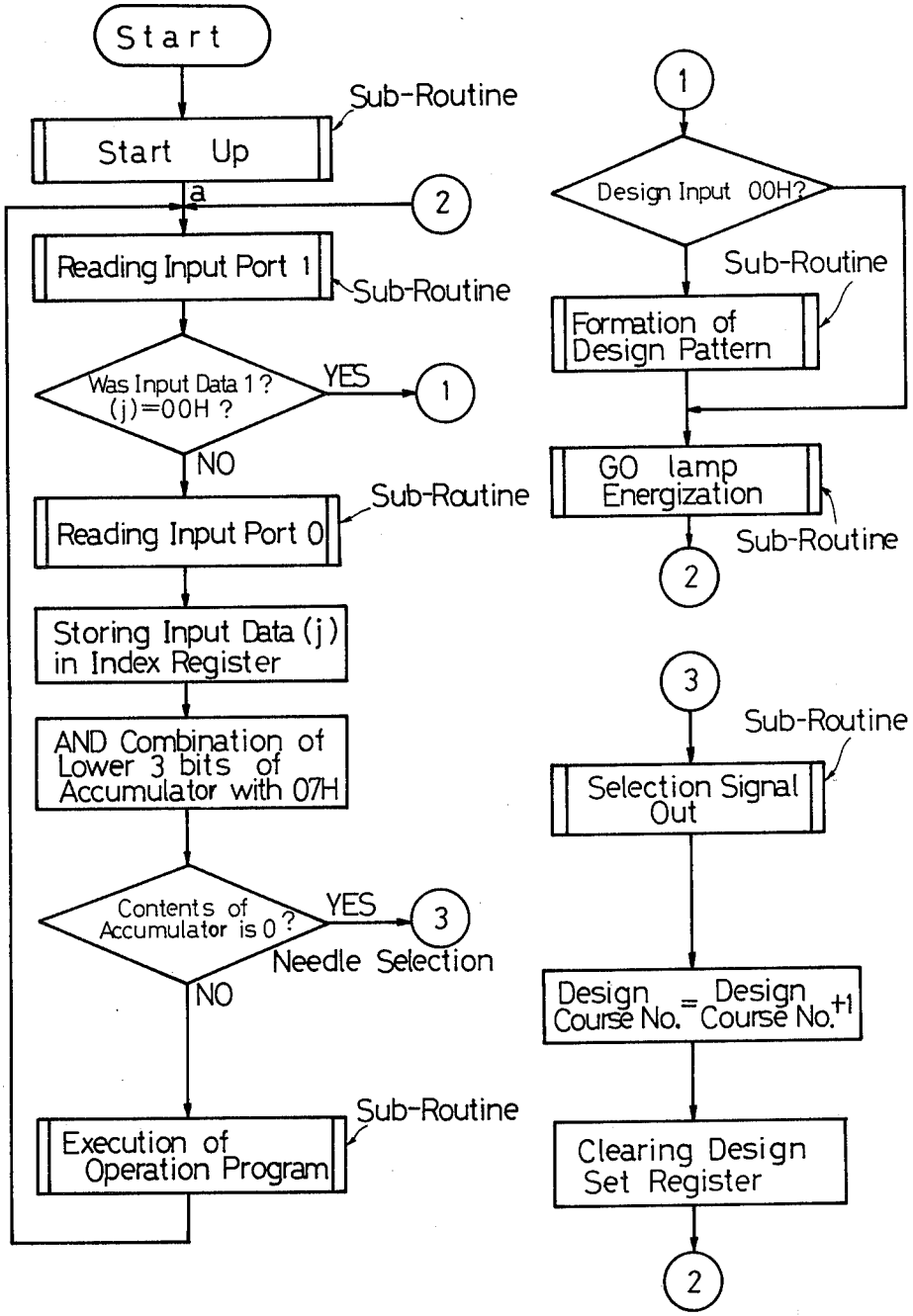
FIGS. 19 through 21, FIGS. 23 through 36, FIGS. 38 through 39, FIGS. 42 through 46 and FIGS. 50 through 52 are flow diagrams showing operation of the micro-computor system 33.
Figure 20:
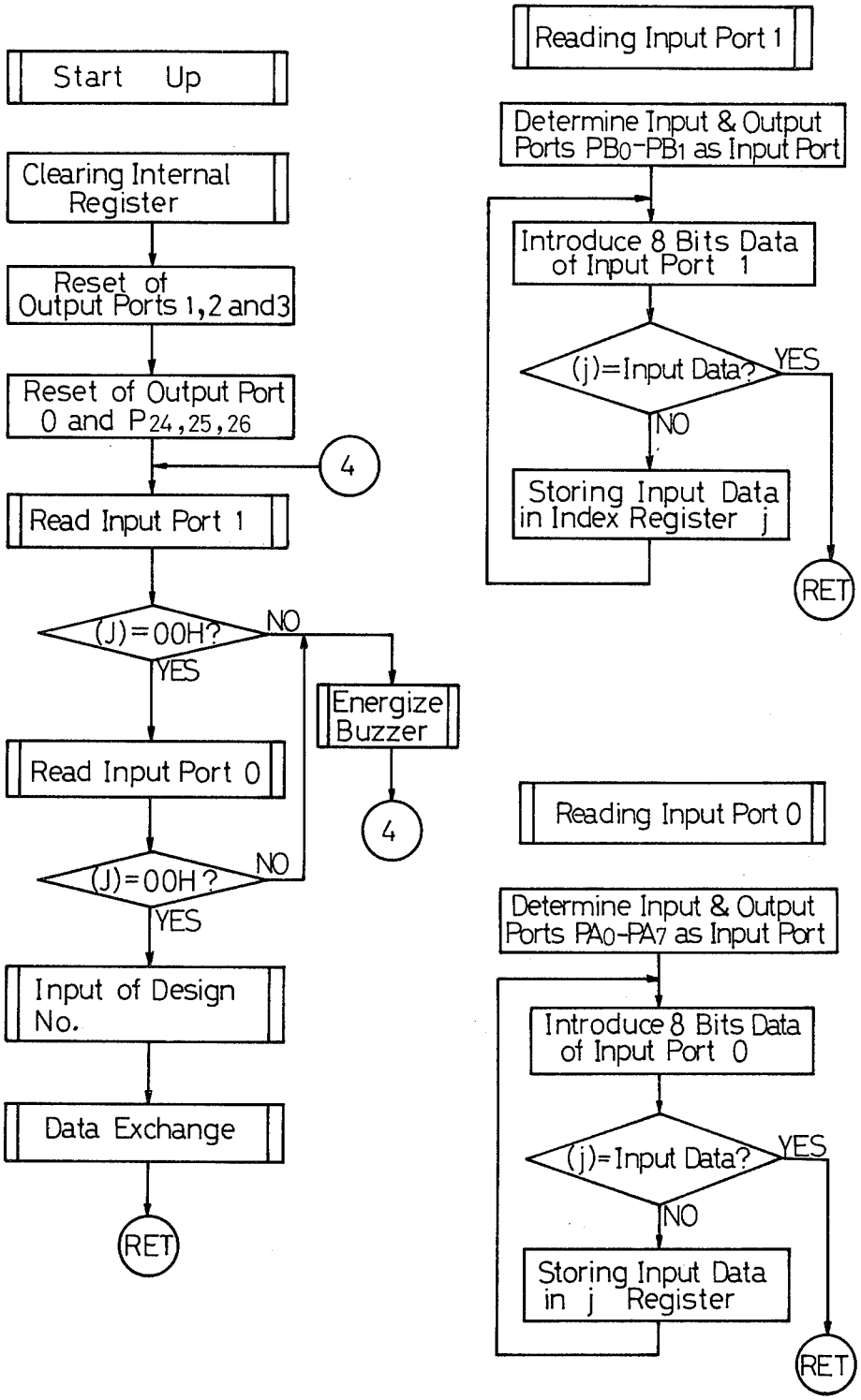
Figure 21:
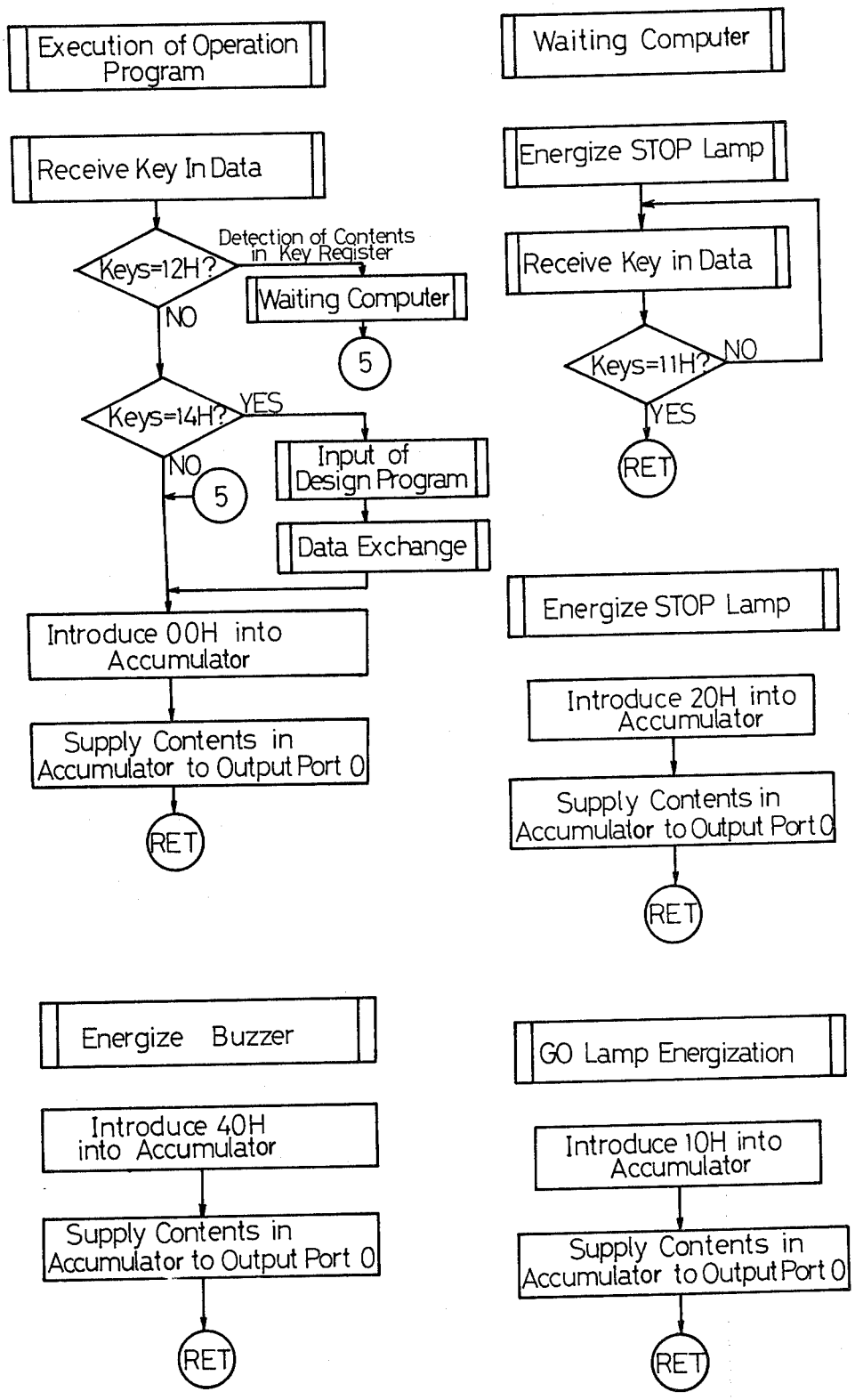

FIG. 19 shows basic operation flow of micro-computor 34. Micro-computor 34 at first executes "Start Up" sub-routine for preparation of operations. The "Start Up" sub-routine is shown in FIG. 20, wherein execution of "Input of Design No." sub-routine is automatically informed to operator. After the "Start Up" sub-routine, the micro-computor system 33 operates and watches state of input circuit 38. When state of input circuit 38 changes, program counter in micro-computor 34 jumps to "Selection Signal Out" sub-routine, "Execution of Operation Program" sub-routine or "Formation of Design Pattern" sub-routine in response to state of input circuit 38. Assuming that input circuit receives input excluding "0" and also only key switch lines are energized, "Execution of Operation Program" sub-routine should be executed. In other cases, micro-computer 34, detecting movement of carriage, executes "Selection Signal Out" sub-routine.

The "Execution of Operation Program" sub-routine is shown in FIGS. 21 through 27, the "Selection Signal Out" sub-routine is shown in FIGS. 28 through 31, and the "Formation of Design Pattern" sub-routine is shown in FIGS. 32 through 47.

Figure 23:
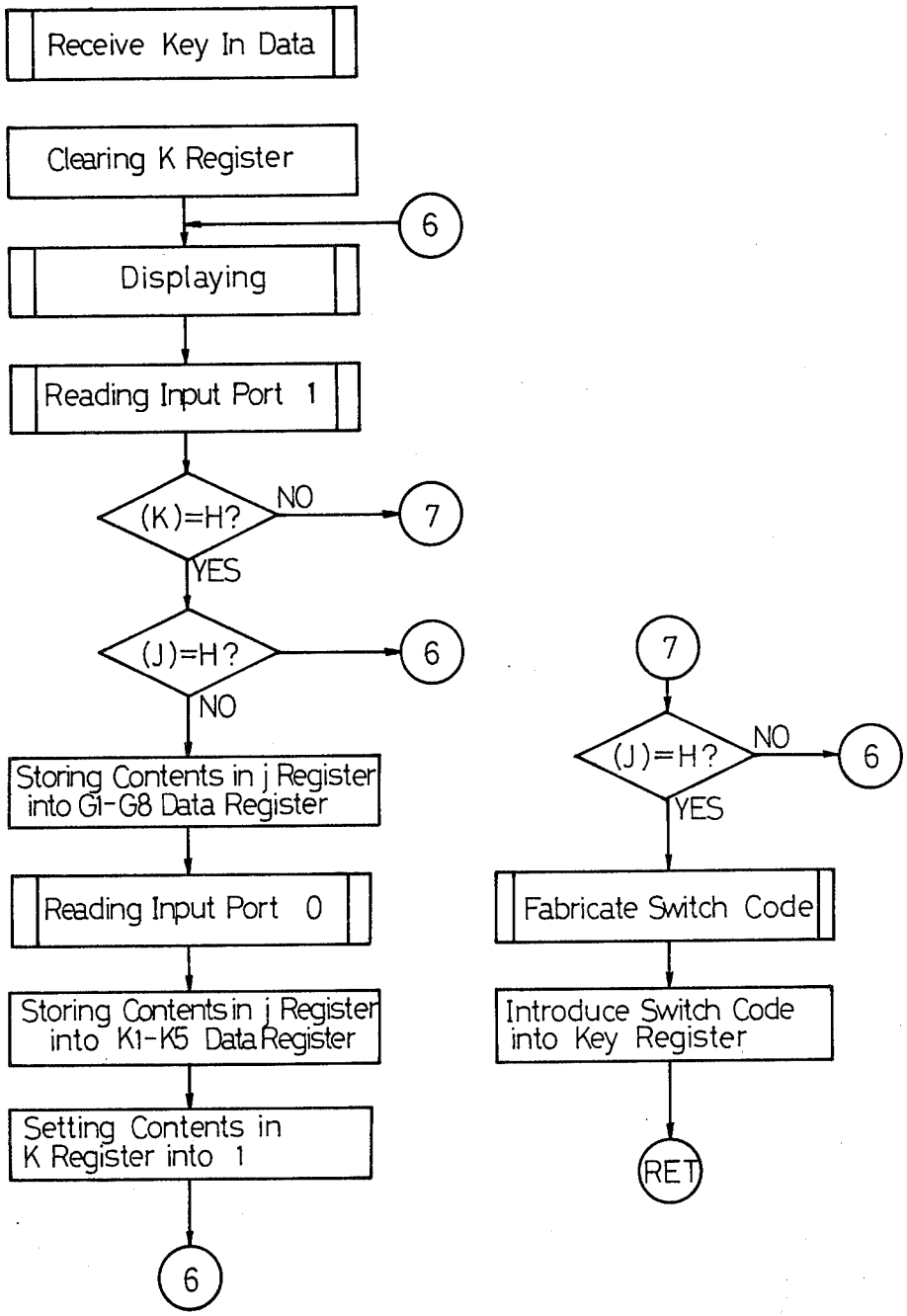
Figure 24:
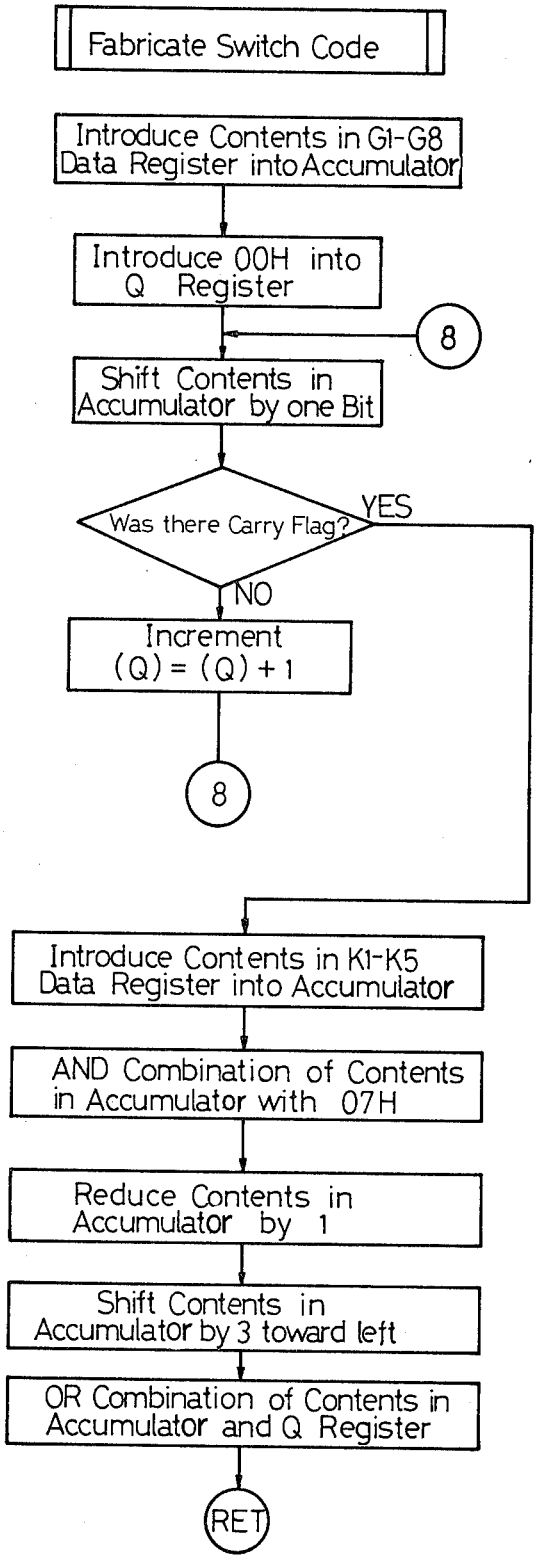

The "Execution of Operation Program" sub-routine (FIGS. 20 through 27) deciphers which key is operated by operator. Decipherment program is executed by "Receive Key In Data" sub-routine (FIGS. 21 through 23), in which data at input ports 0 and 1 are fabricated into 8 bits code by "Fabricate Switch Code" sub-routine (FIGS. 23 and 24). The 8 bits code is decipherred in micro-computor 34. The 8 bits code and its contents are shown in FIG. 22. Program jumps to "Waiting Computor" sub-routine (FIG. 21) and to "Input of Design No." sub-routine (FIGS. 21 and 25) when the 8 bits switch code is "12H" then to "Data Exchange" sub-routine (FIGS. 20 and 28) when the 8 bits switch code is "14H".

Figure 25:
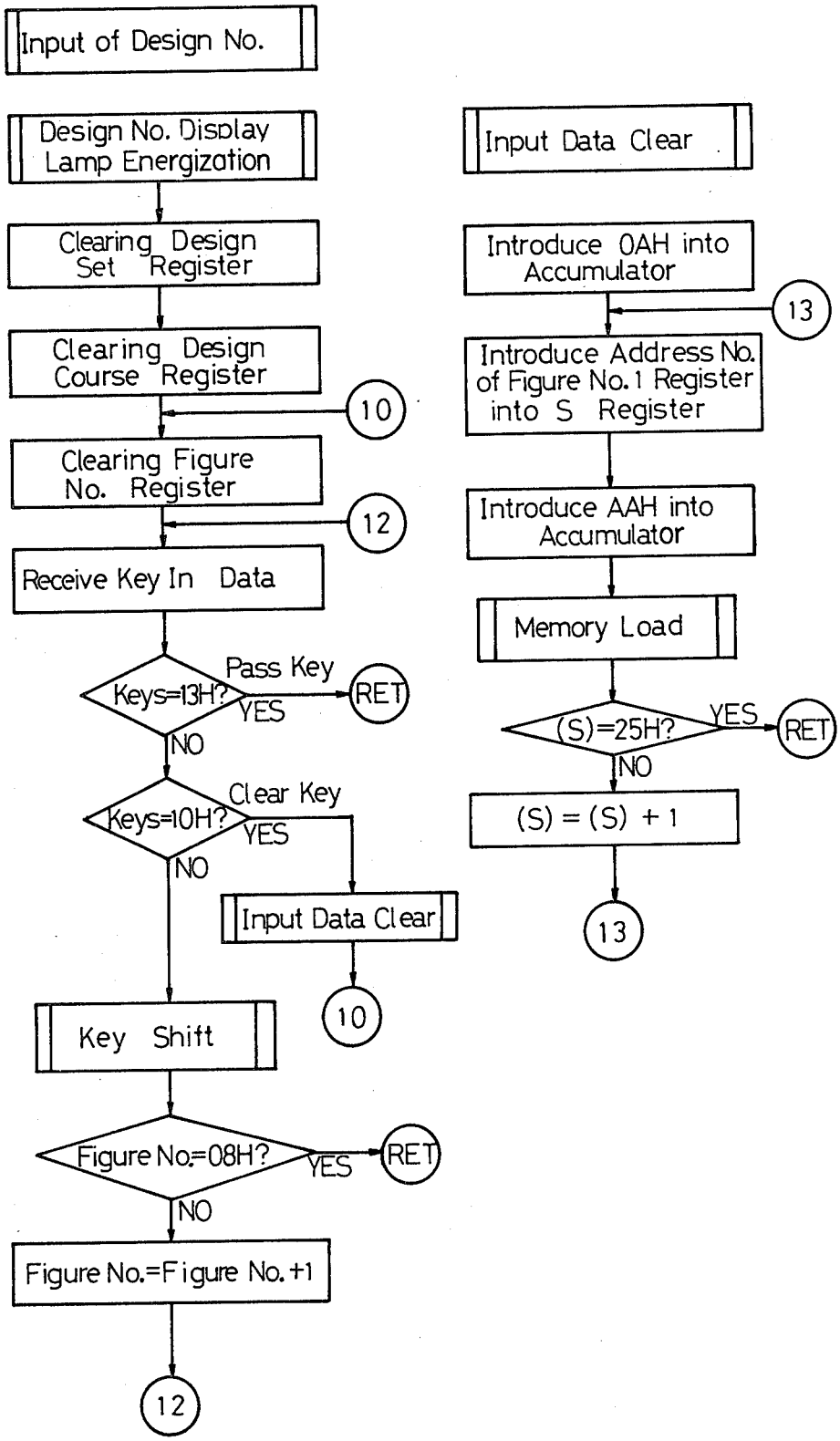
Figure 26:
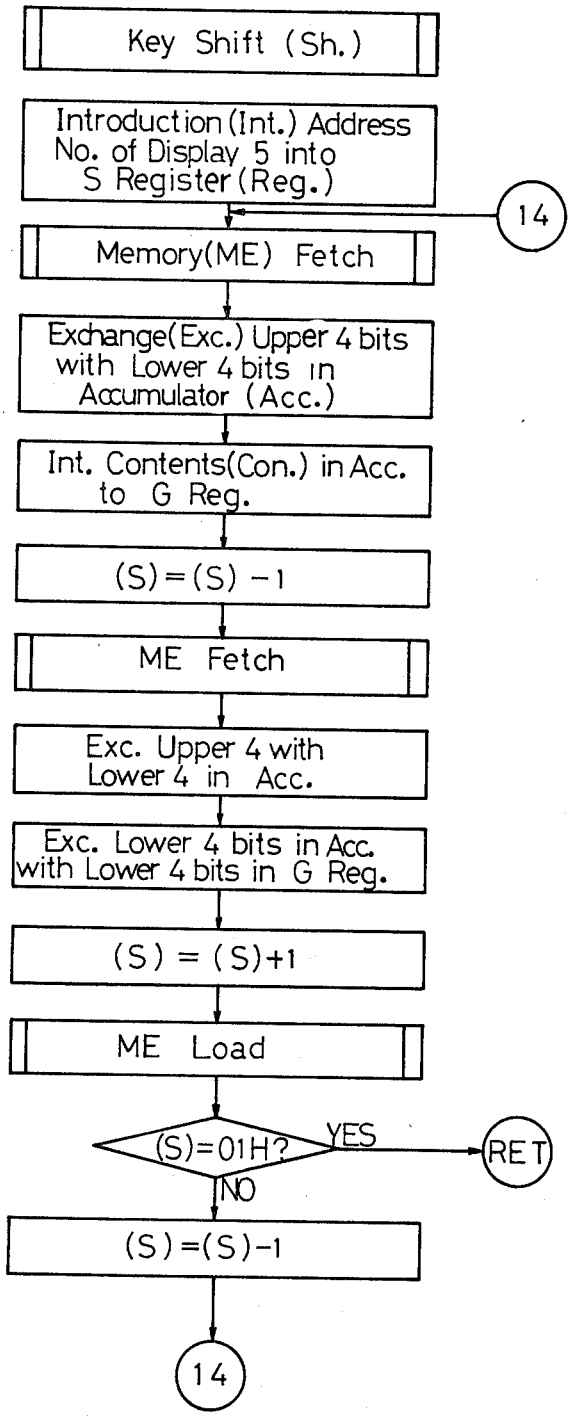
Figure 27:
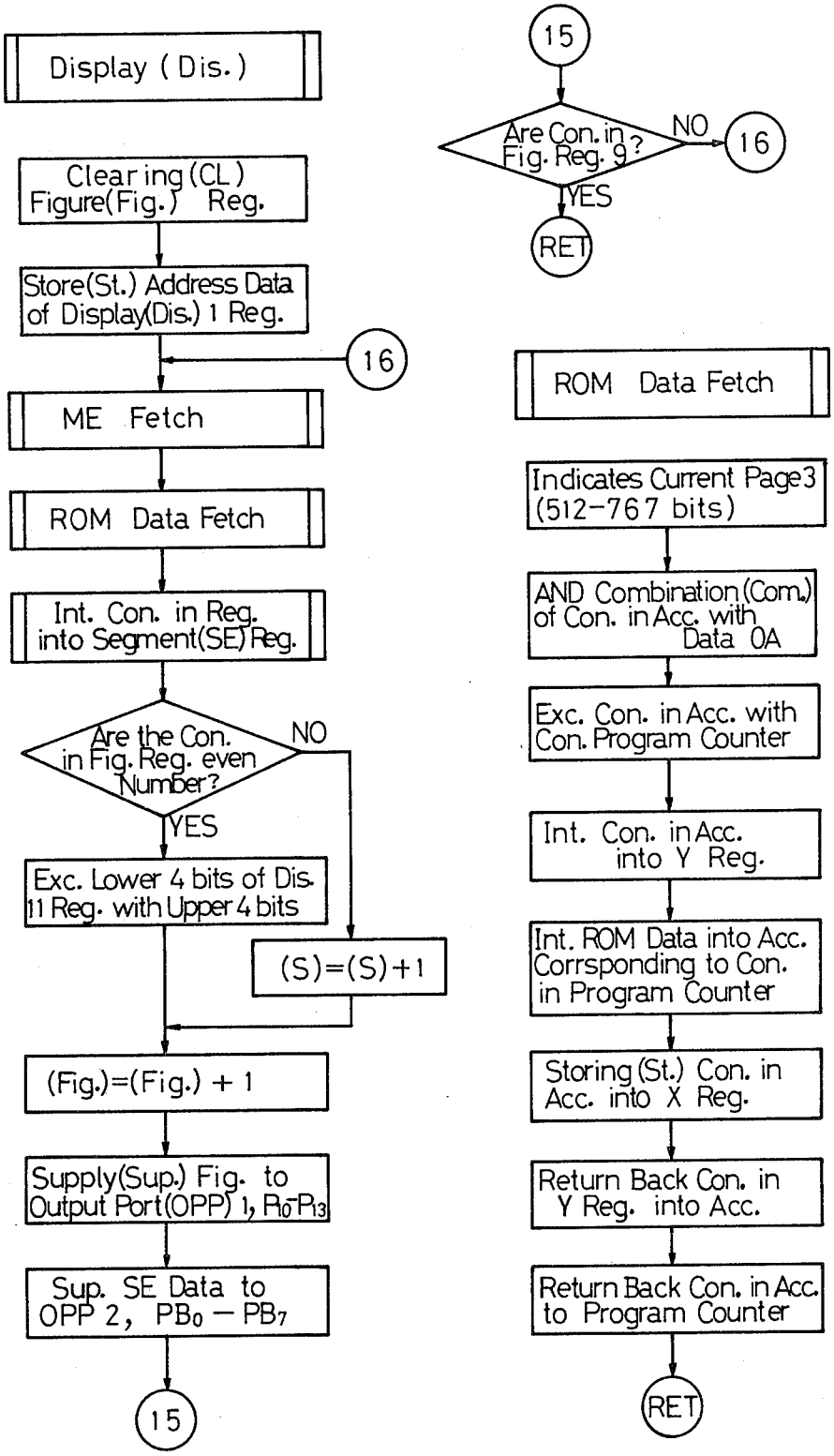
Figure 28:
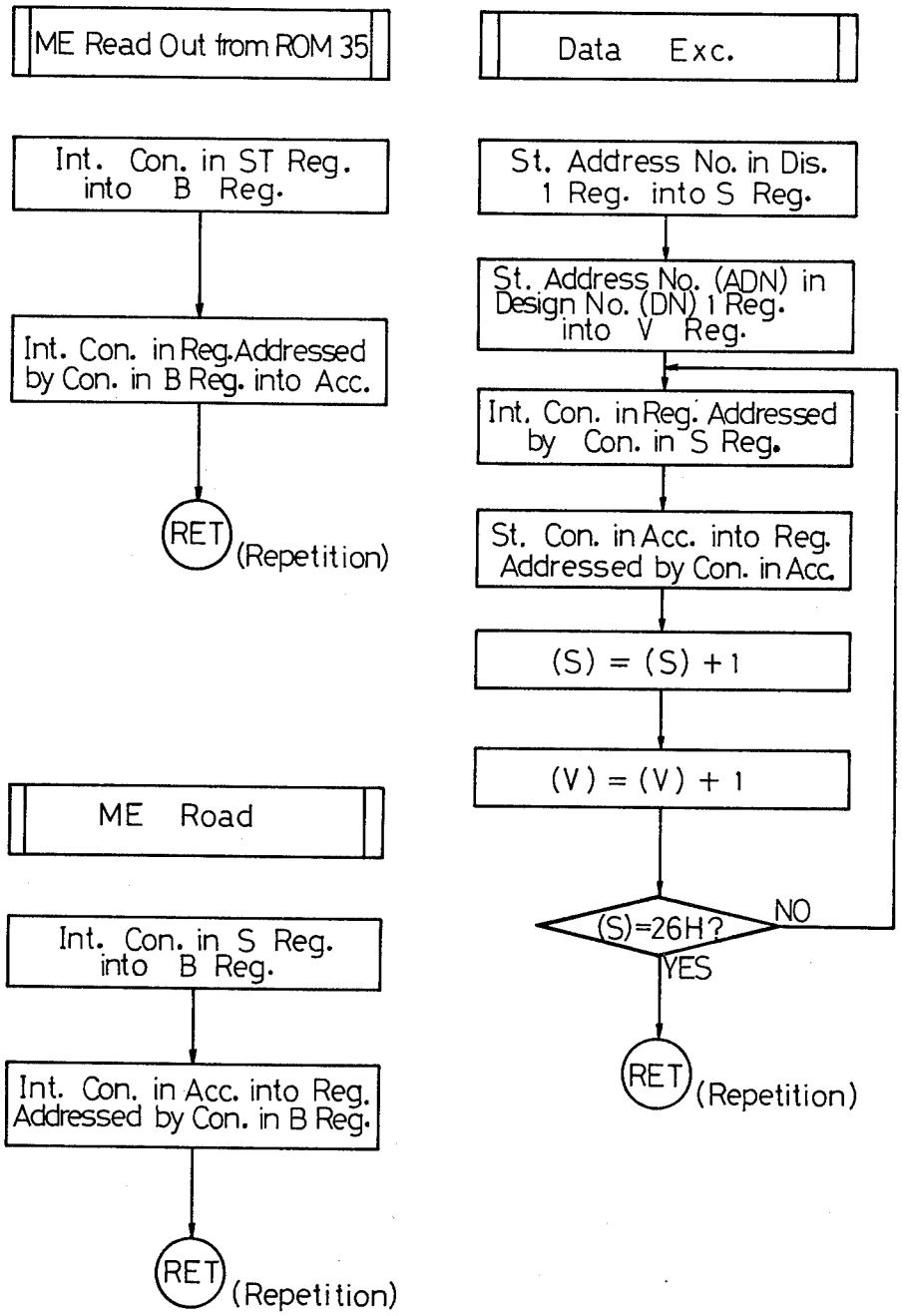

In "Input of Design No." sub-routine (FIG. 25), at first "Design No. Display Lamp Energization" sub-routine is executed to supply out indicator data to indicator driver 44. Then operator actuates key switches $K_{y0}$-$_0$–$K_{y07}$, $K_{y10}$–$K_{y17}$ by 8 times to supply computer 34 design pattern indication code. At first actuation of a key switch, lower 4 bits of key code are introduced in key register then the 4 bits are shifted to next register by "Key Shift" sub-routine (FIGS. 25 and 26). At second actuation of a key switch, lower 4 bits of key code are introduced in the register pushing the preceding 4 bits code by "Key Shift" sub-routine. Upon actuating "Clear" key switch, data introduced in the register are cancelled to "0" by "Input Data Clear" sub-routine (FIG. 25). After actuating key switches by 8 times, "Input of Design No." sub-routine is finished. To finish the sub-routine before actuation of key switches by 8 times, operator actuates "Pass" key switch. Actuation of "Pass" key switch jumps program to "Data Exechange" sub-routine (FIGS. 20 and 28).

Display 1–5 registers are used for storing display data and also for key in data exchange. Display data in the registers are exchanged with design No. data in design No. 1–4 registers by "Data Exchange" sub-routine shown in FIG. 28 in which "Exc." means "Exchange", "St." means "Store", "Dis" means "Display", "Reg." means "Register", "Con." means "Content", "ME" means "Memory" and "Acc." means "Accumulator". Display 5 register has a memory of "OOH" after execution of "Start Up" sub-routine (FIG. 20). Display on the display unit 50 is executed by "Display" sub-routine (FIG. 27) in which contents in display 1–5 registers are separated into segment data a–g and figure data A–D and supplied to display driver circuit 43.

Figure 29:
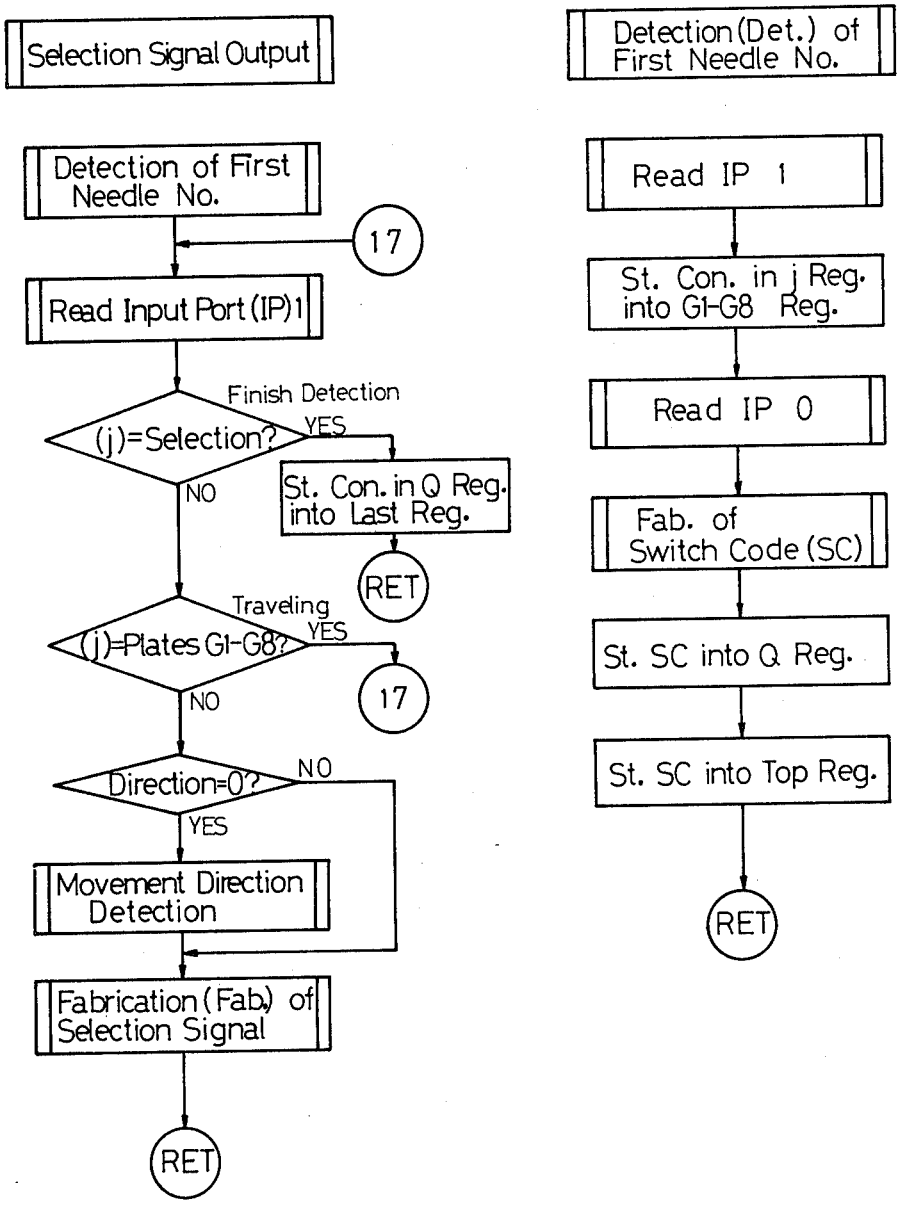
Figure 30:
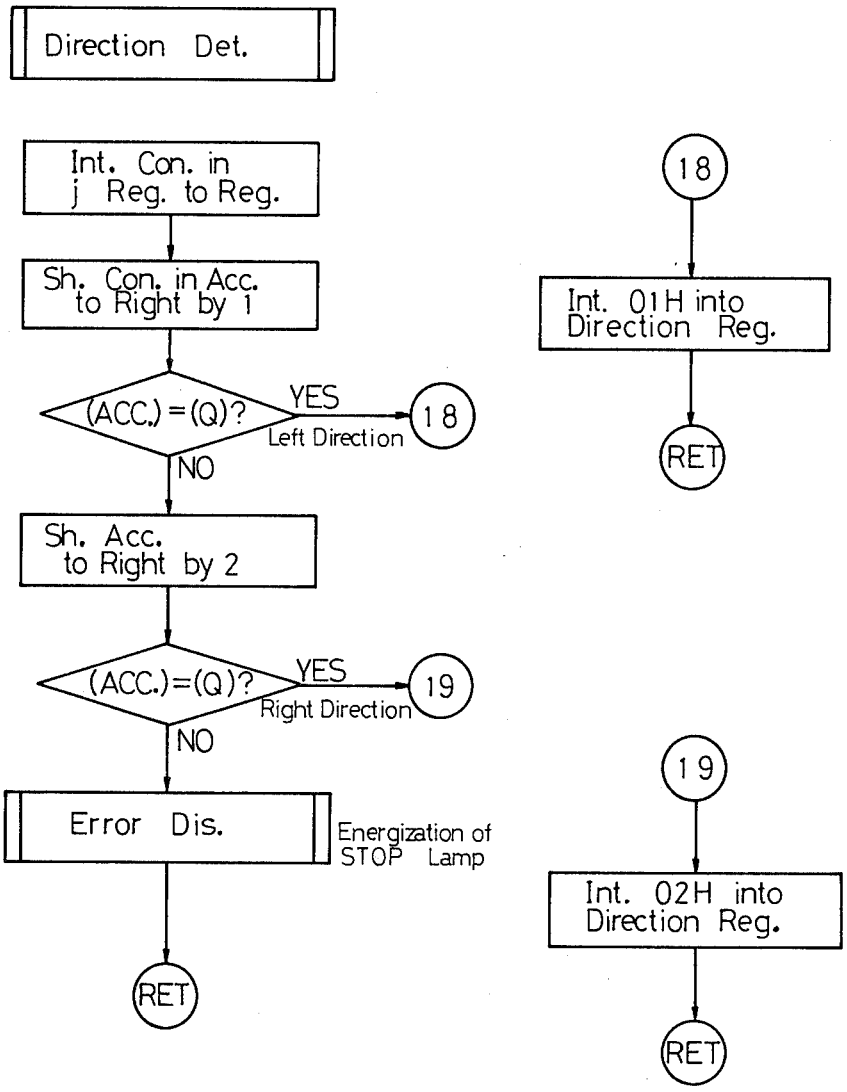
Figure 31:
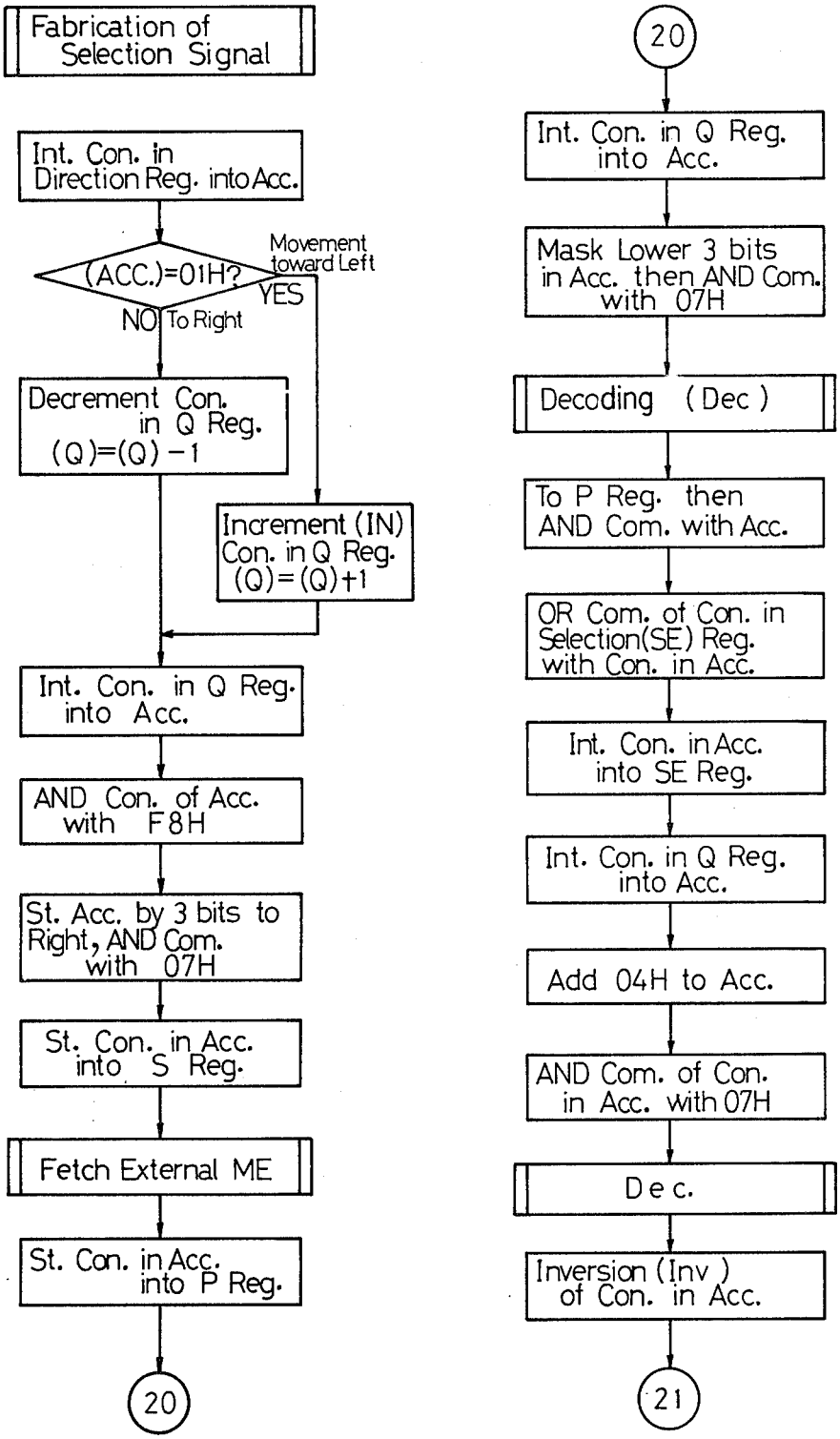
Figure 32:
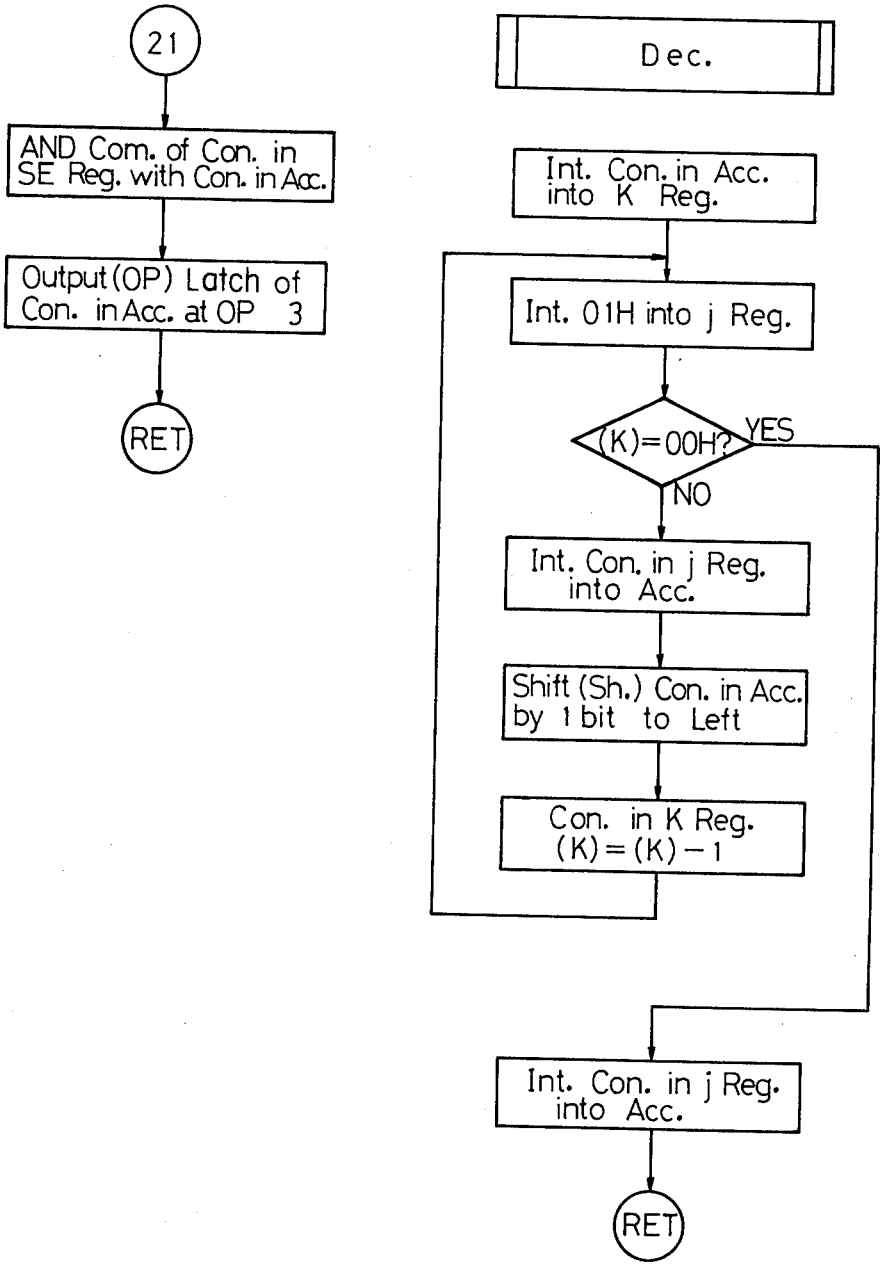

Referring FIGS. 29 through 31 which show contents in "Selection Signal Output" sub-routine, depression of top needle No., e.g. outer most right side needle No. assuming that carriage traverses toward left, is detected by "Detection of First Needle No." sub-routine. Then micro-computer operates so as to decide whether needle selection is required or not. When depression of next needle No. is detected, direction of traversing movement of carriage is detected by "Movement Direction Detection" sub-routine (FIGS. 29 and 30) in which needle Nos. of the first depressed needle and the second depressed needle are compared. "Fabrication of Selection Signal" sub-routine, in which needle selection data in design 0–7 registers are supplied out in accordance depression of needles, is shown in FIG. 31. Output timing of needle selection signal in response to needle No. depressed is operated out by "Decoding (Dec.)" sub-routine shown in FIG. 32.

Figure 33:
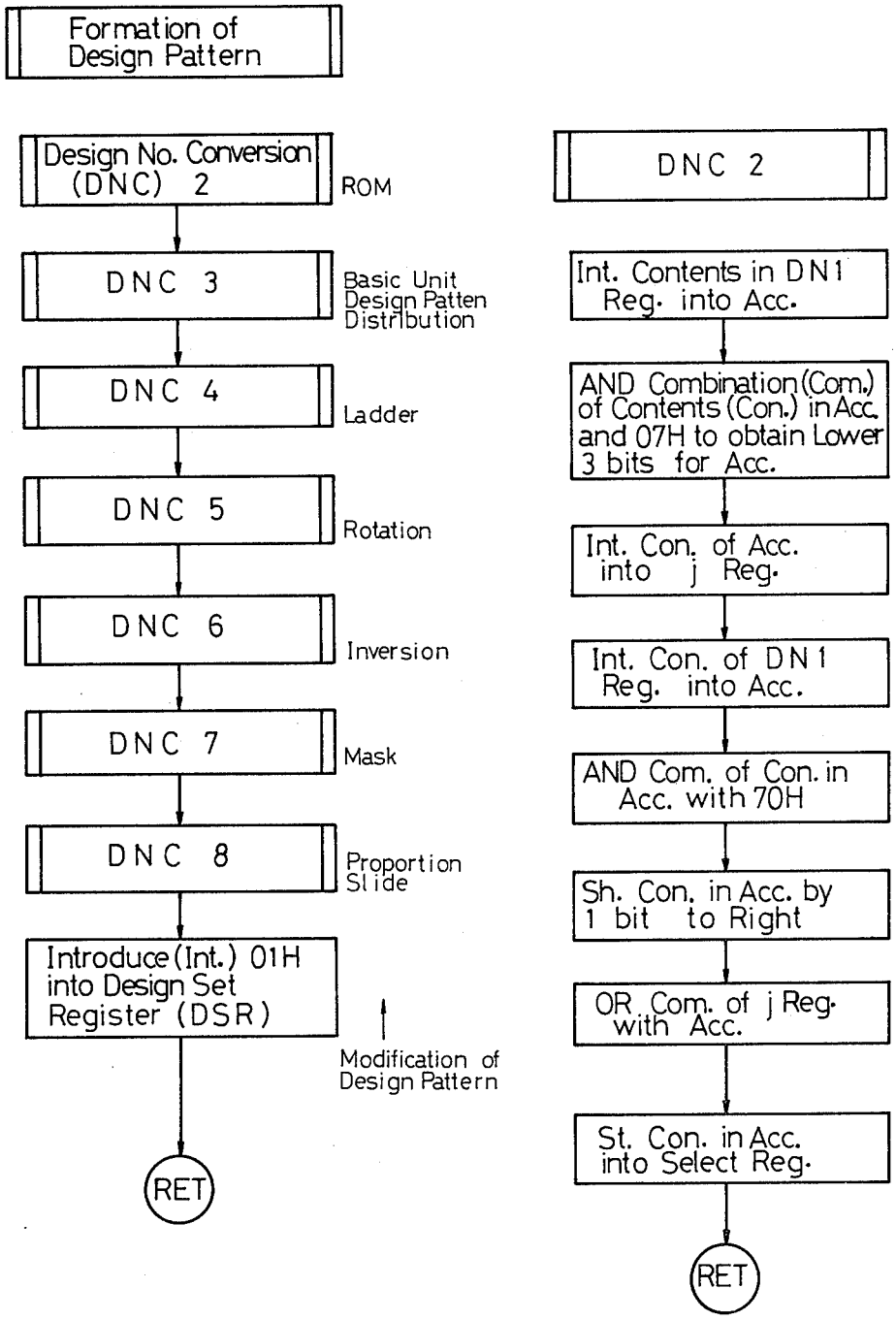
Figure 34:
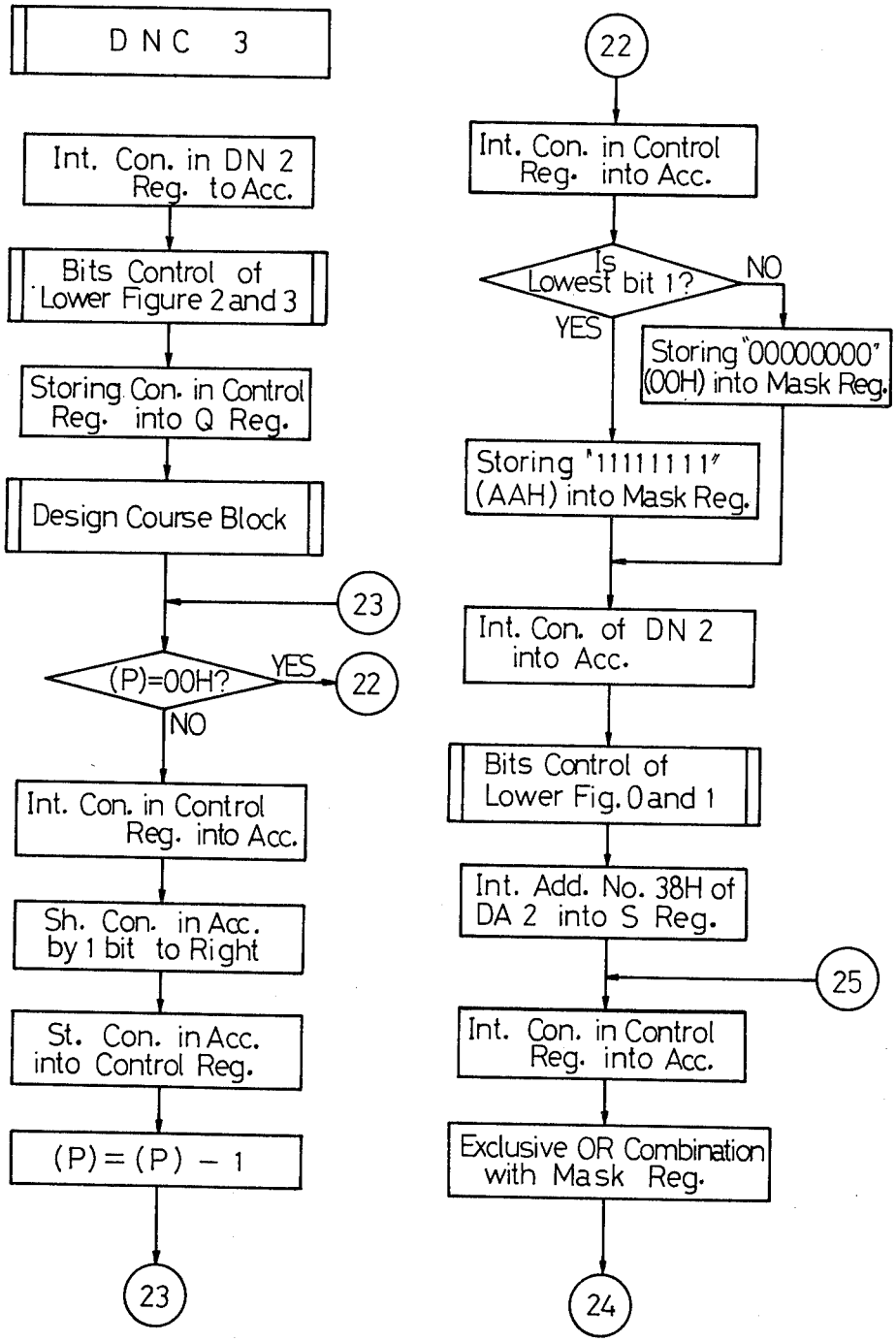
Figure 35:
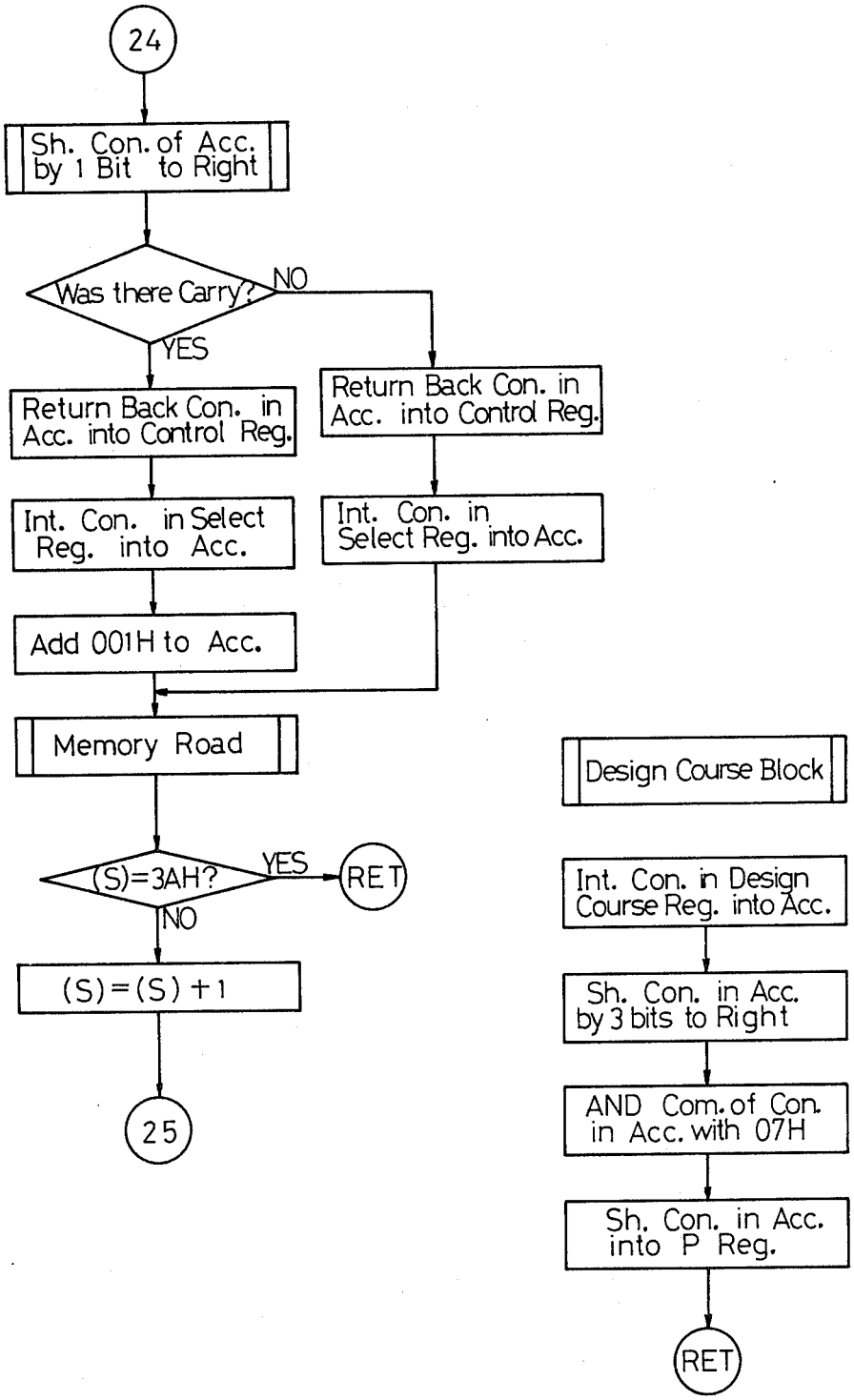
Figure 36:
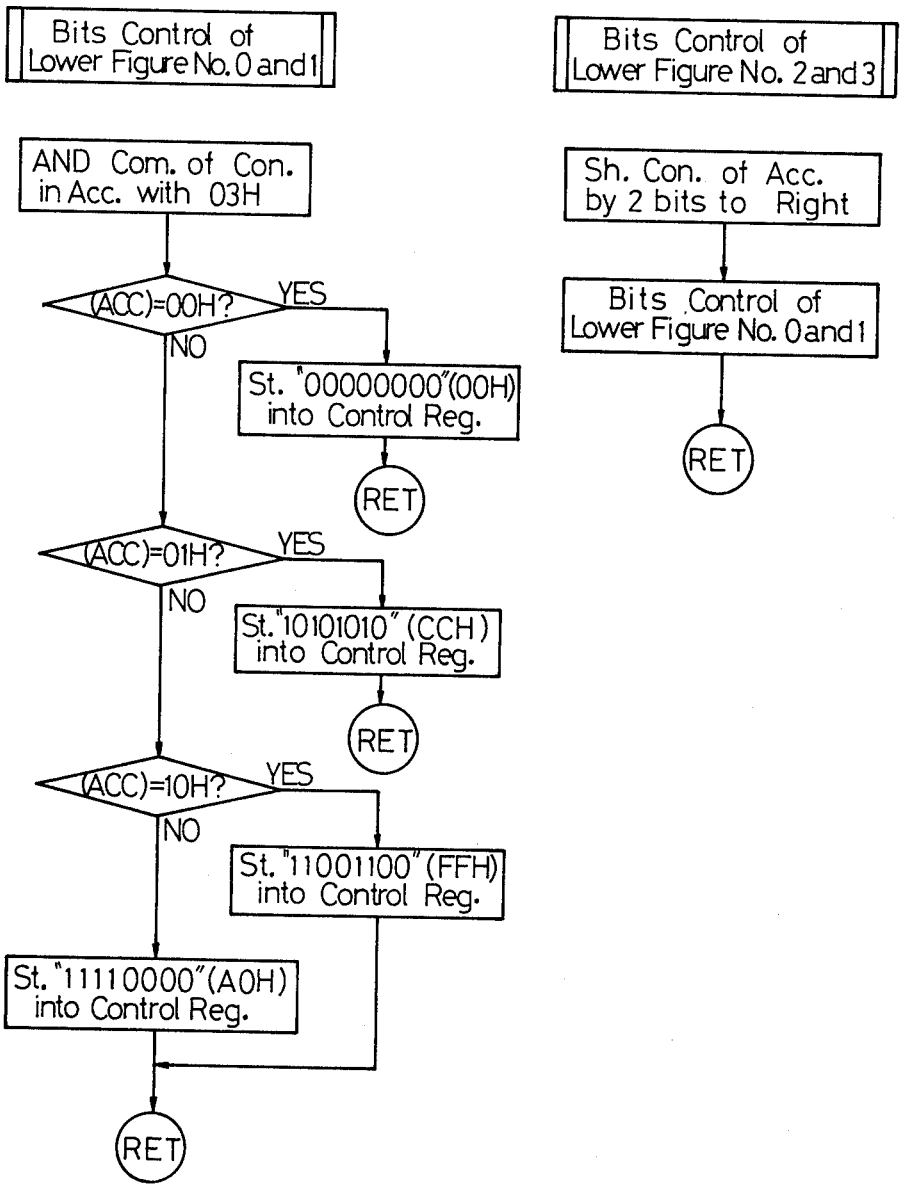
Figure 37:
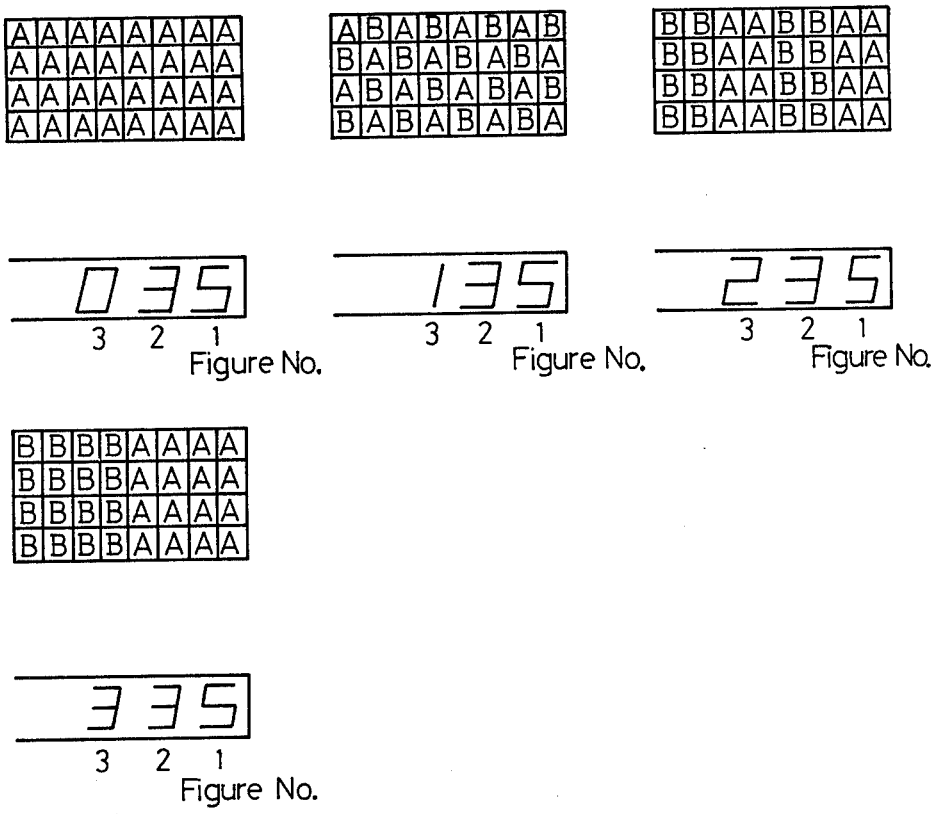
FIGS. 37, 40, 41, 47, 48 and 49 shows selected position of basic unit design patterns.
Figure 38:
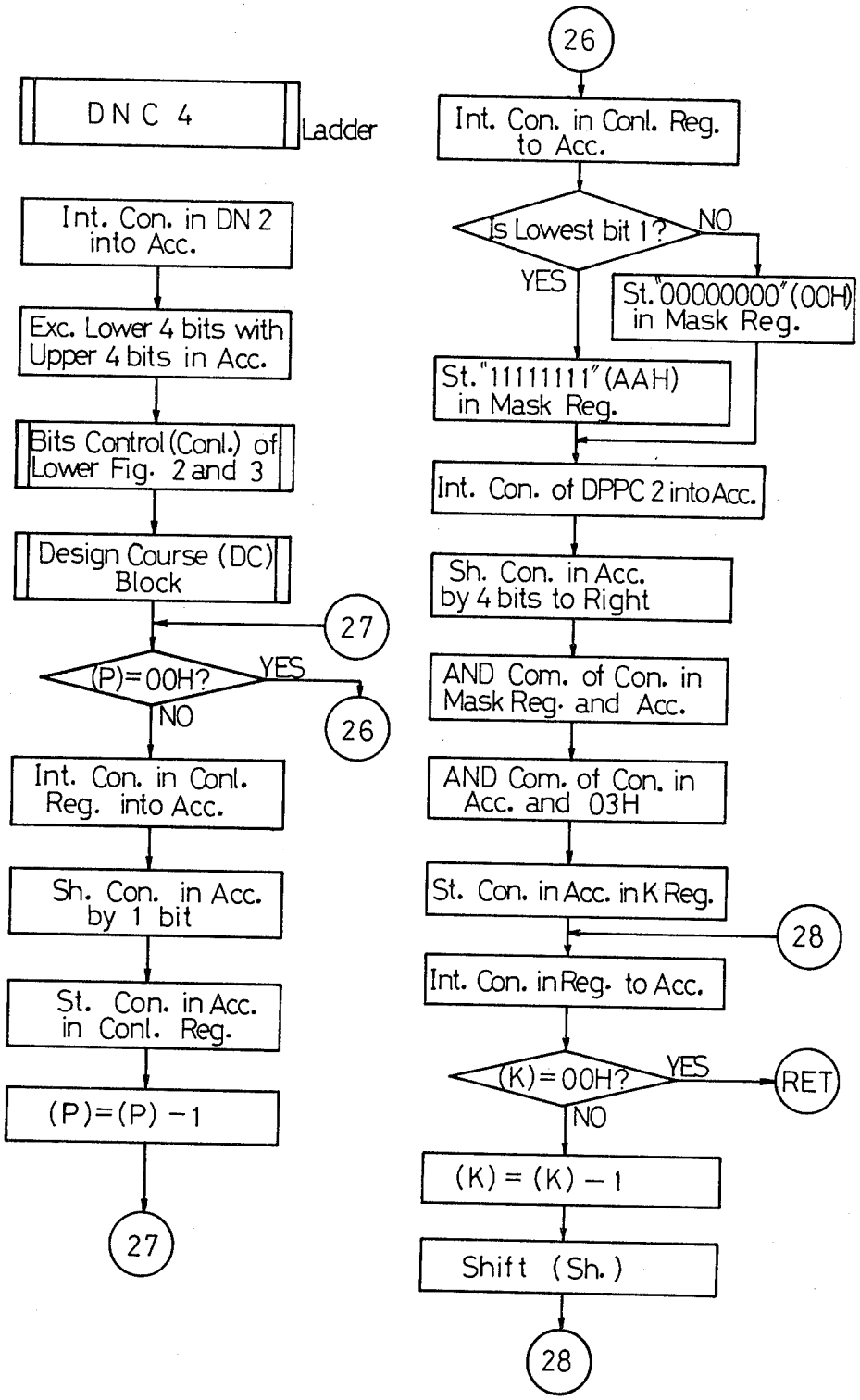
Figure 39:
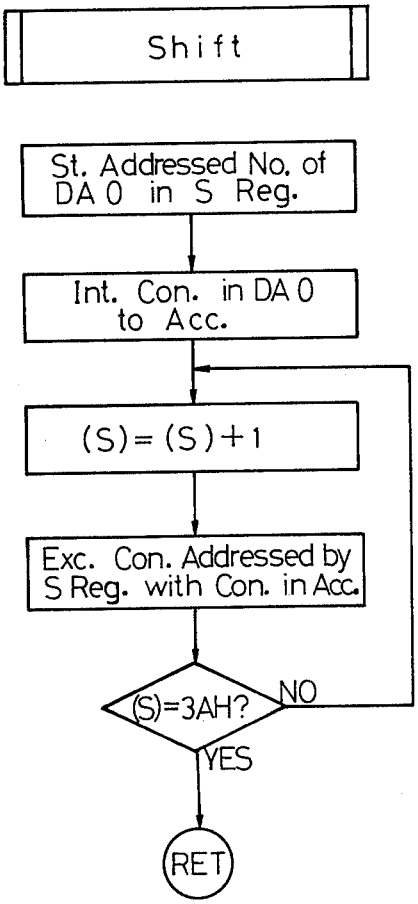
Figure 40:
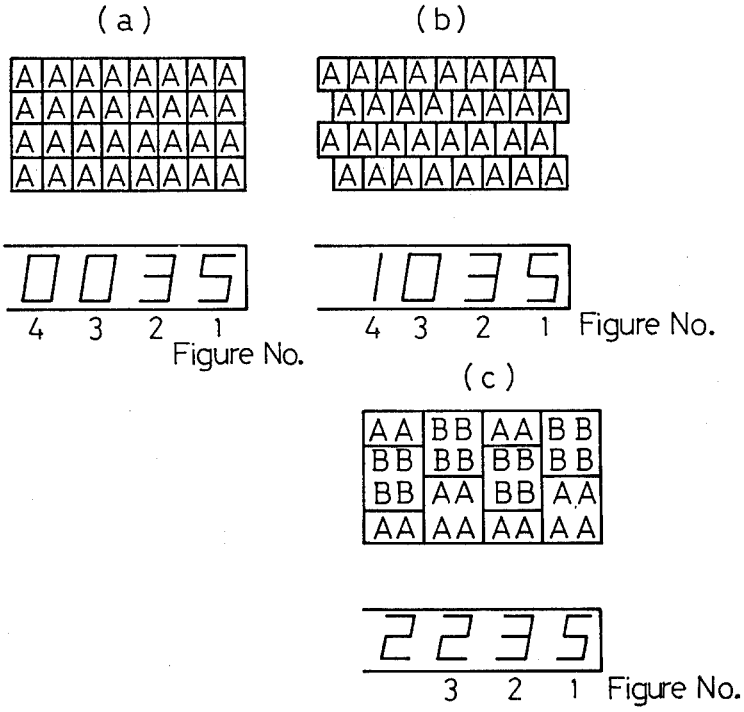
Figure 41:
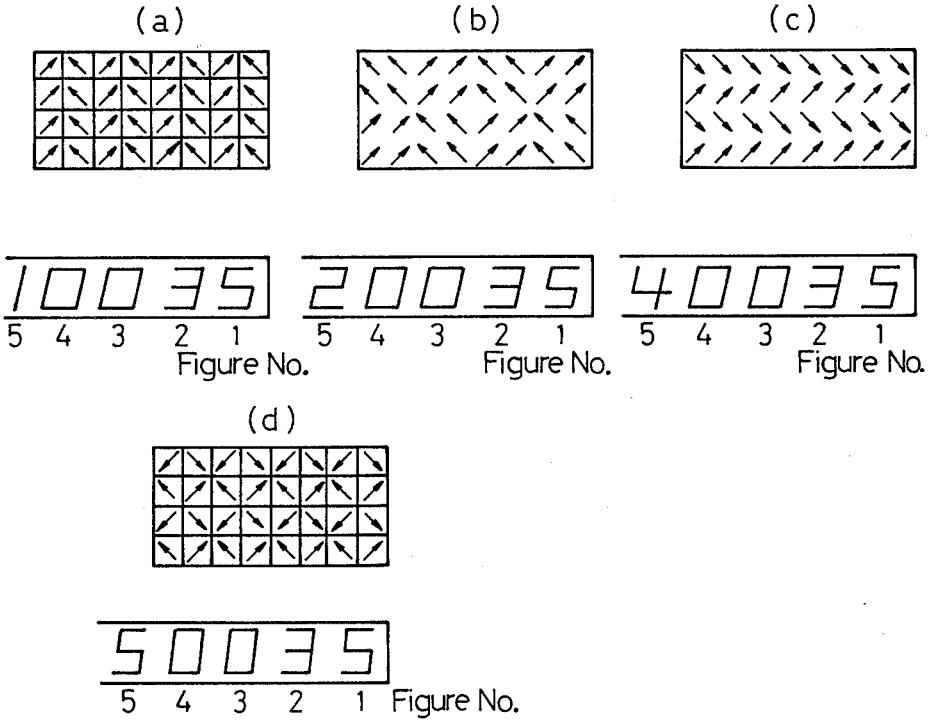
Figure 42:
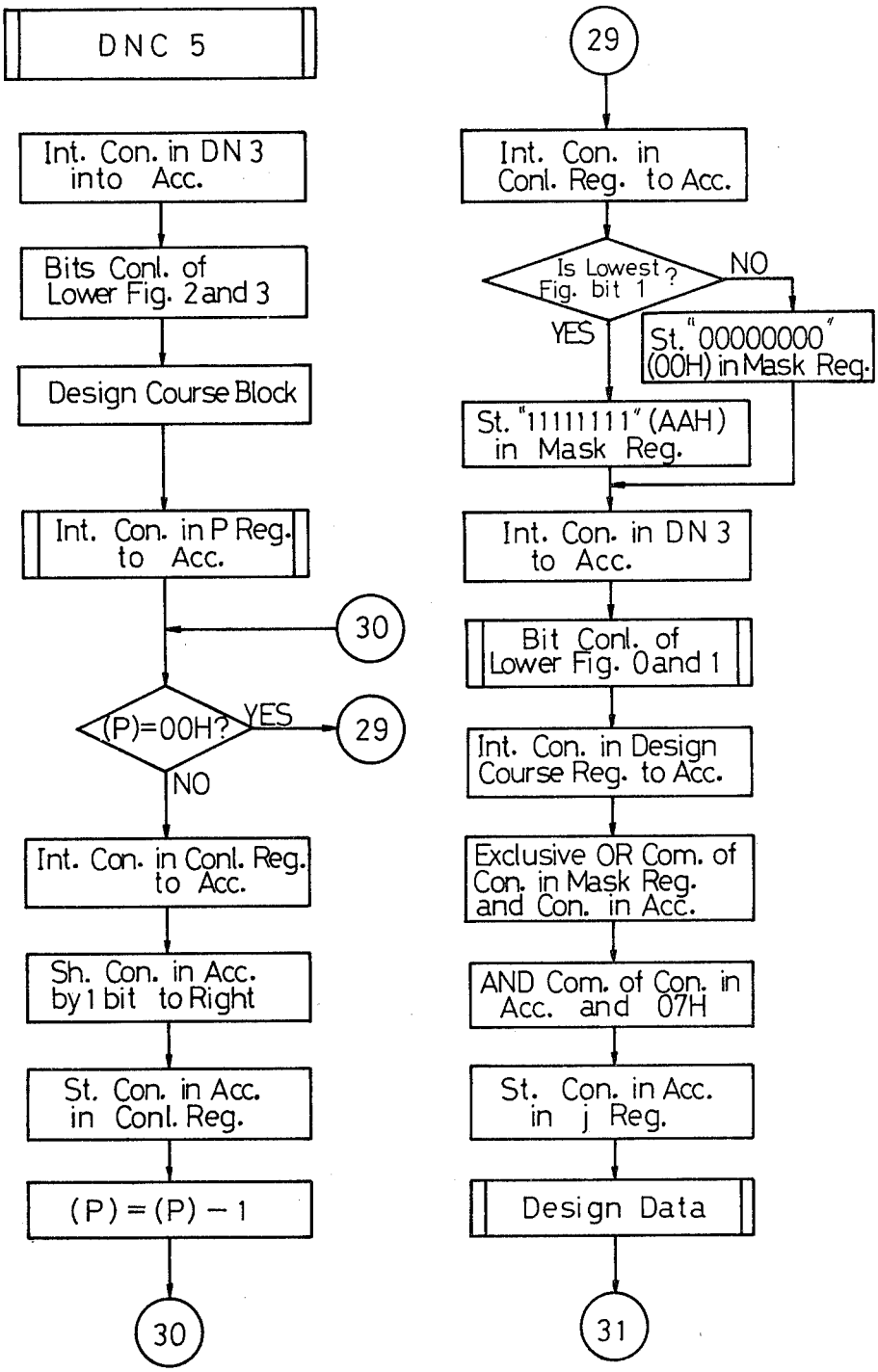
Figure 43:
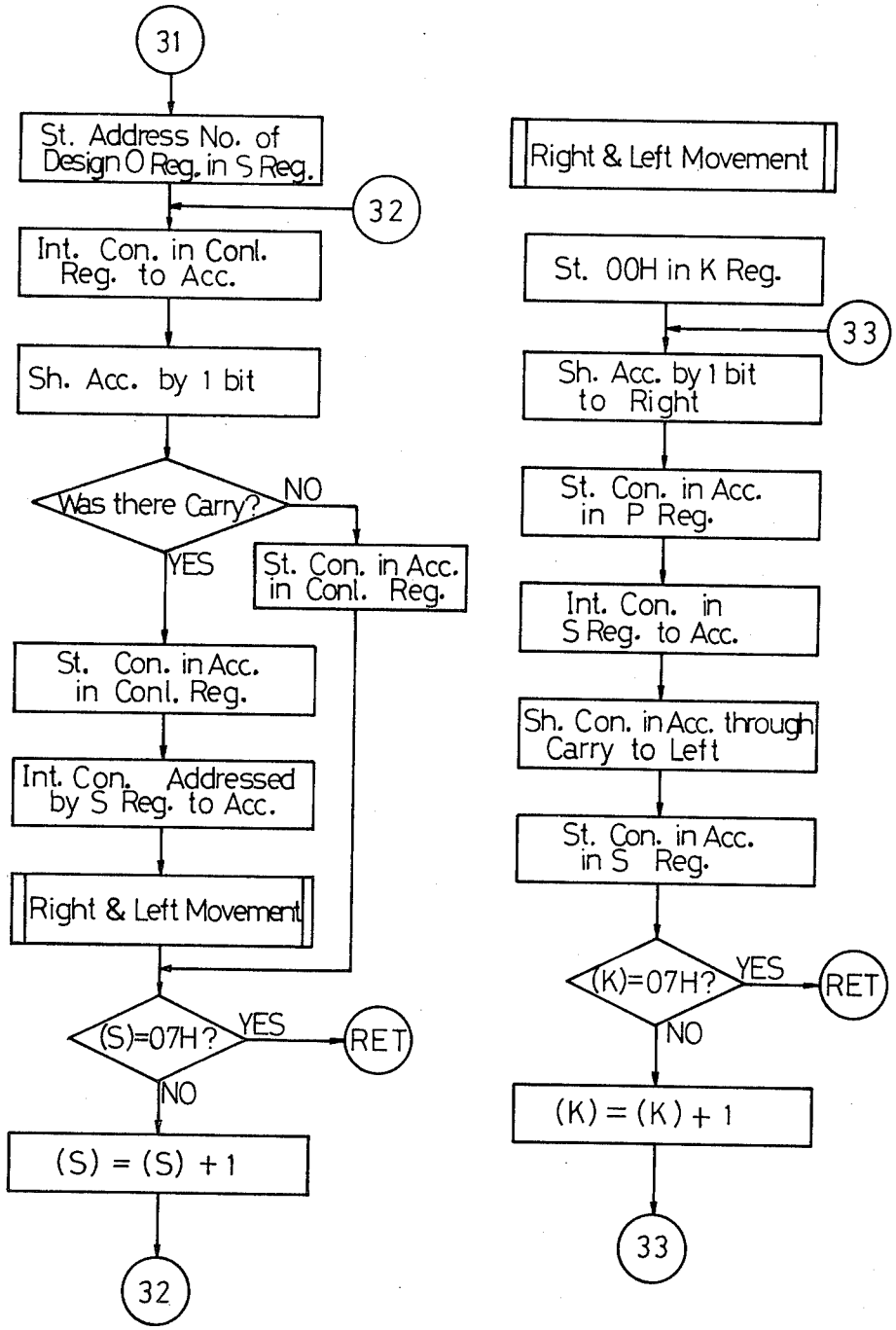
Figure 44:
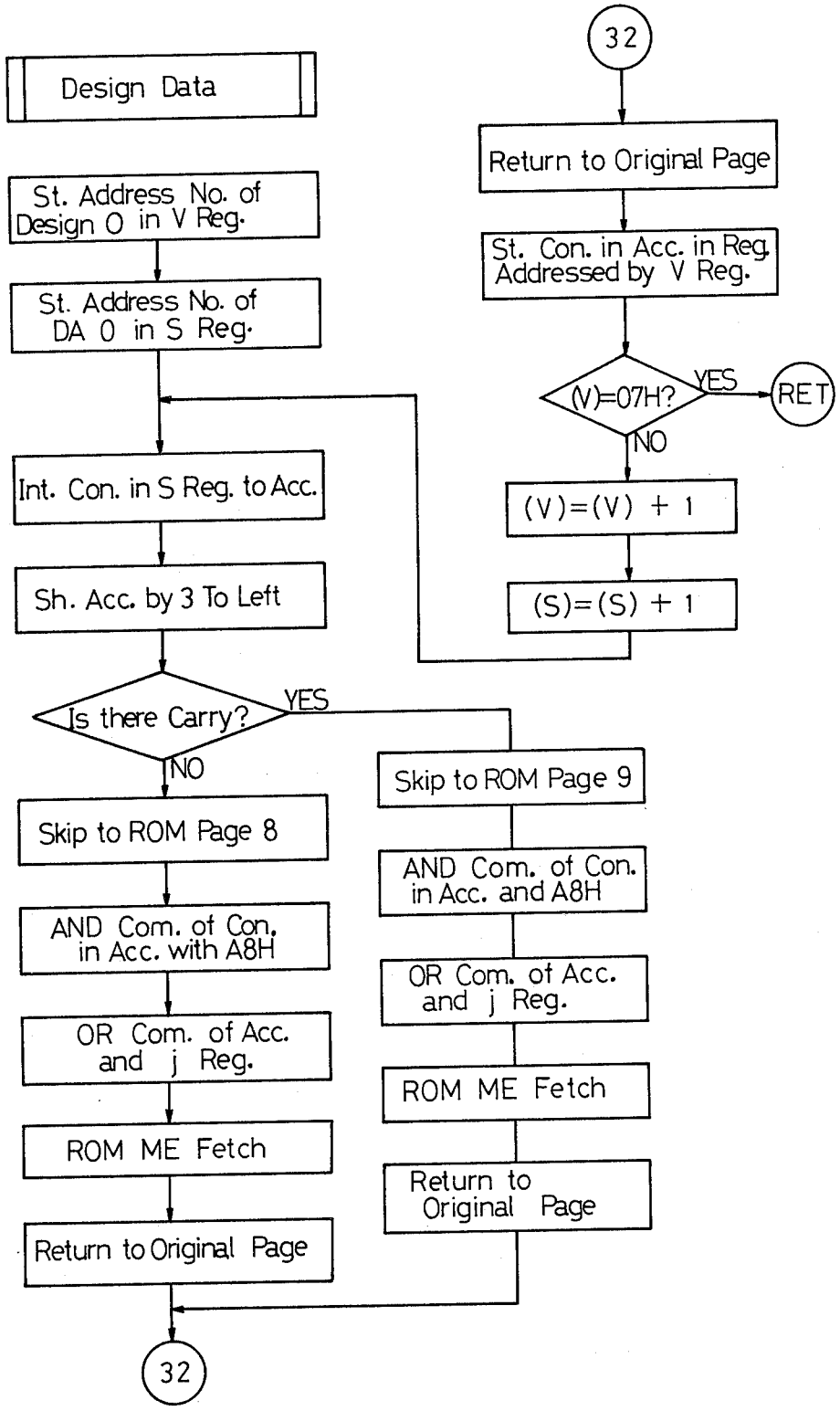
Figure 45:
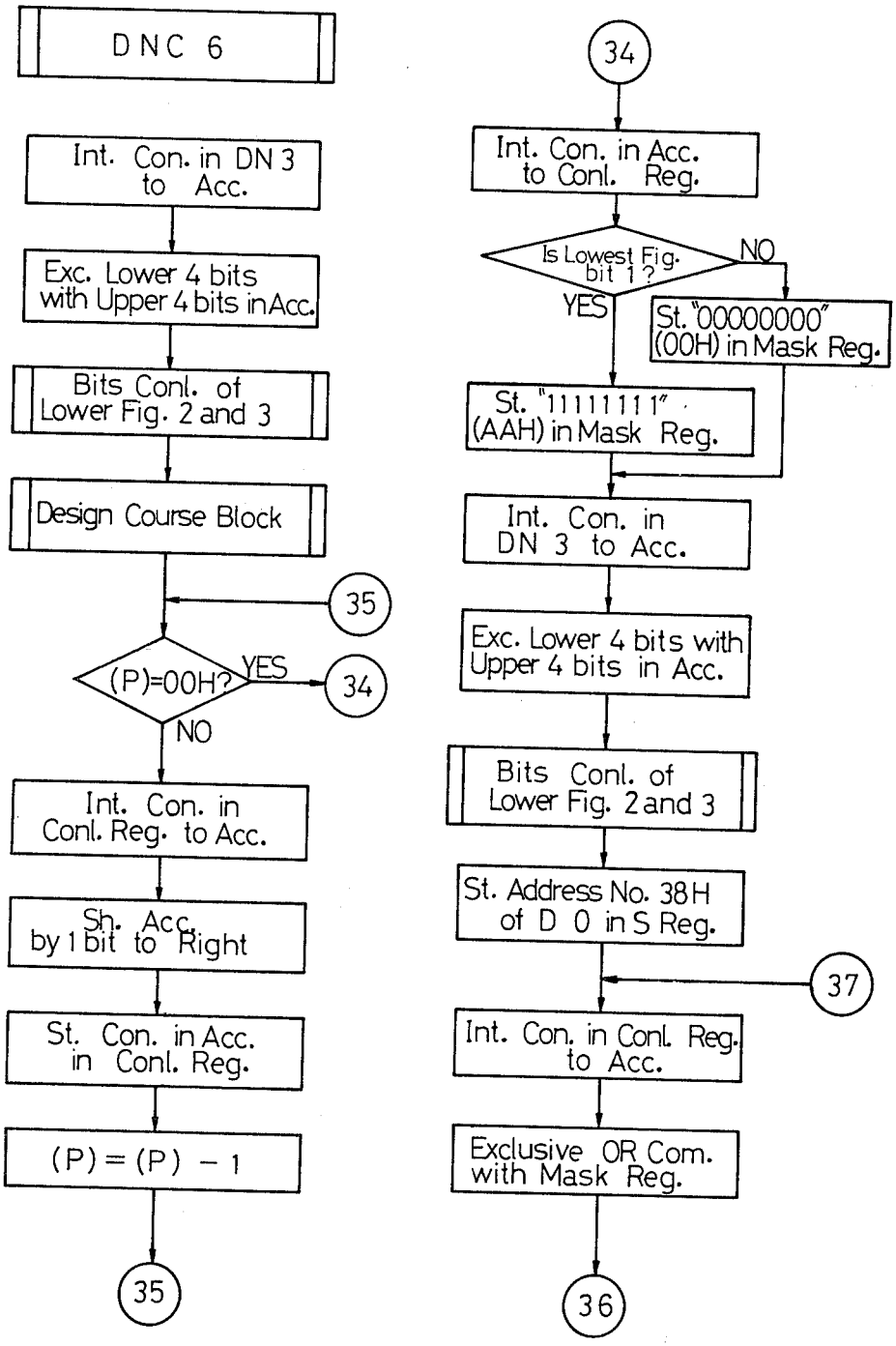
Figure 46:
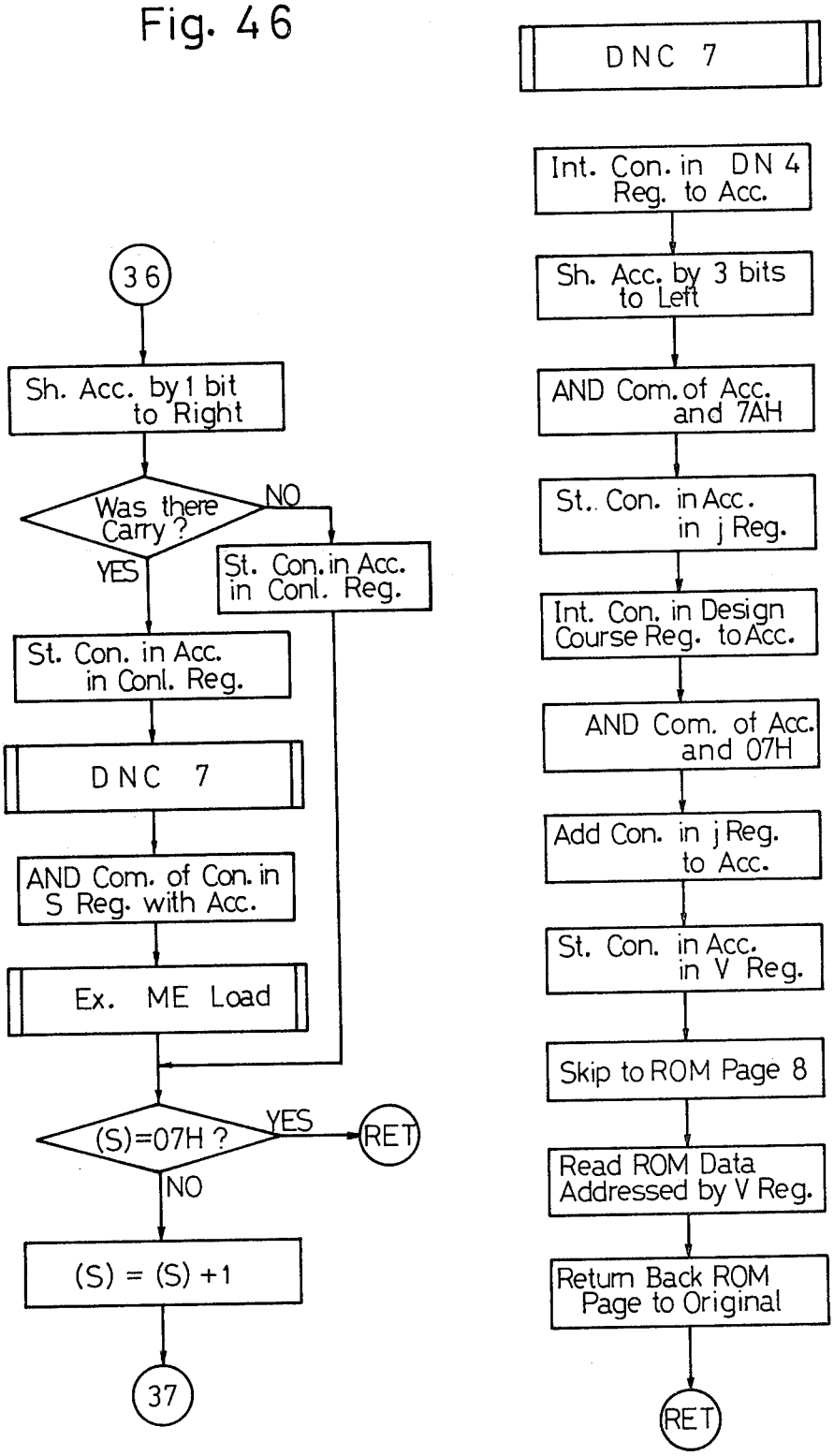
Figure 47:
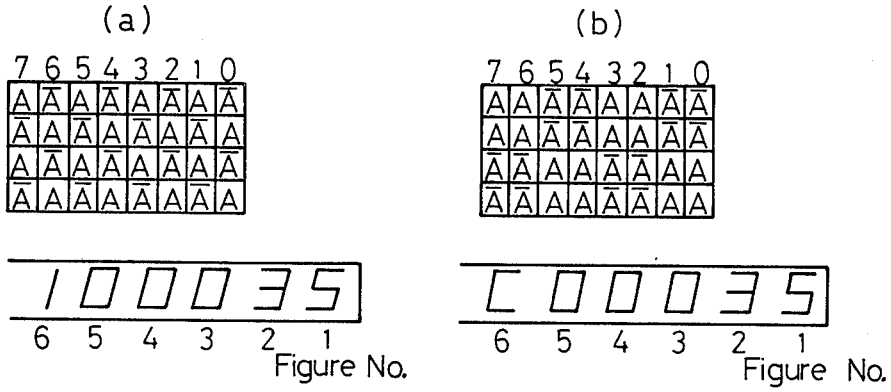
Figure 48:
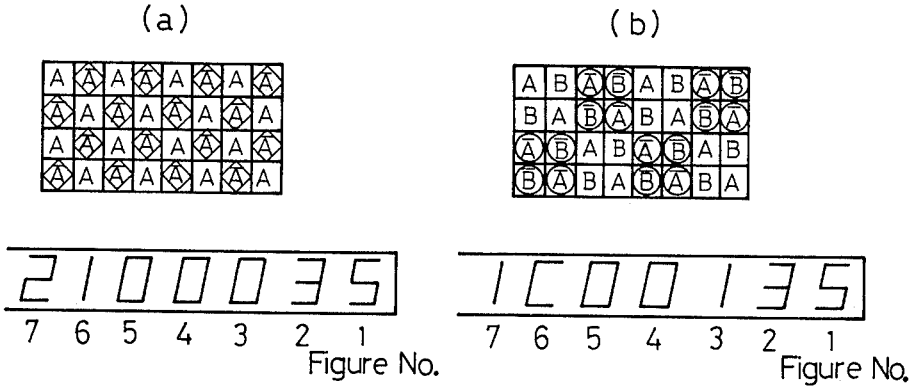
Figure 49:
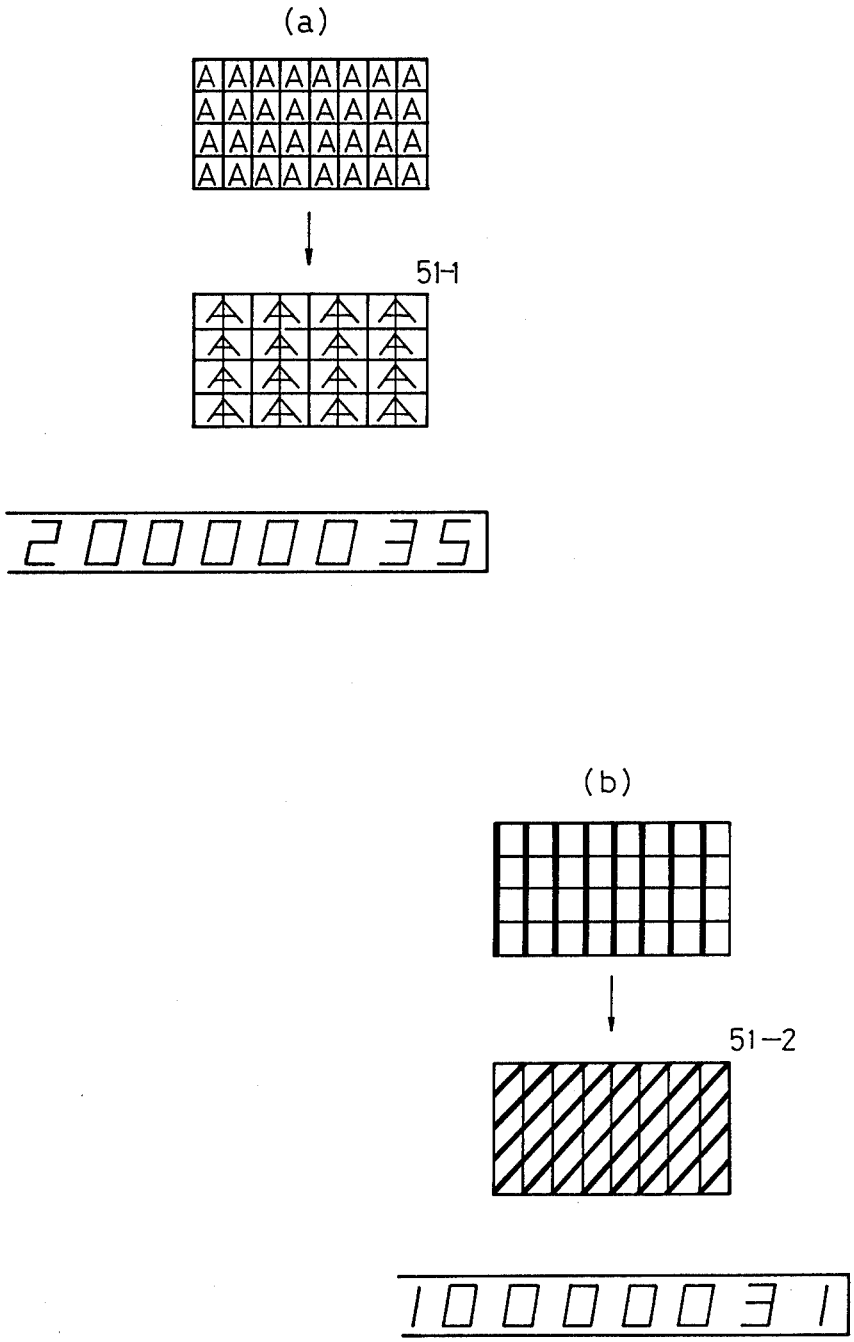
Figure 50:
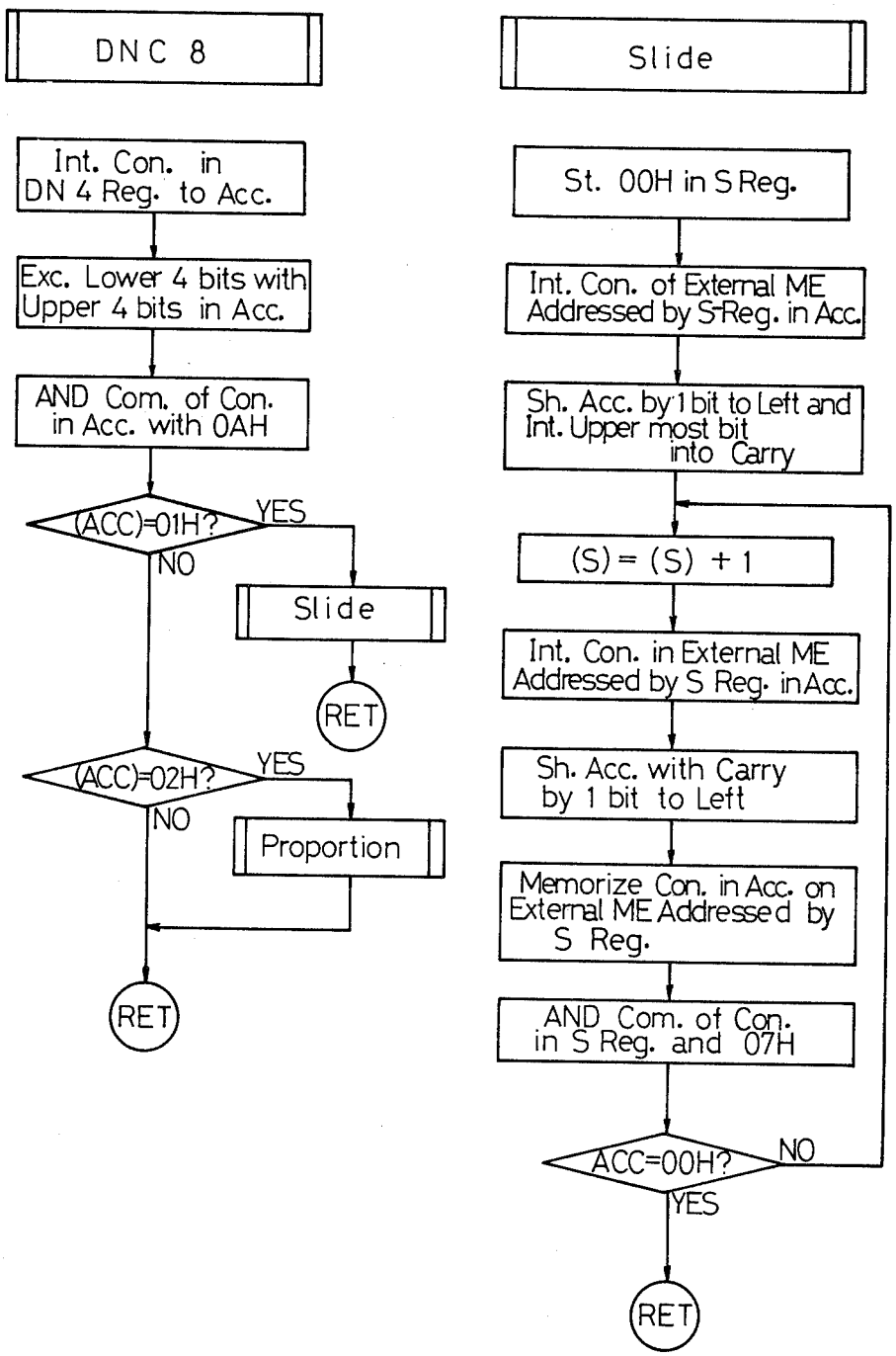
Figure 51:
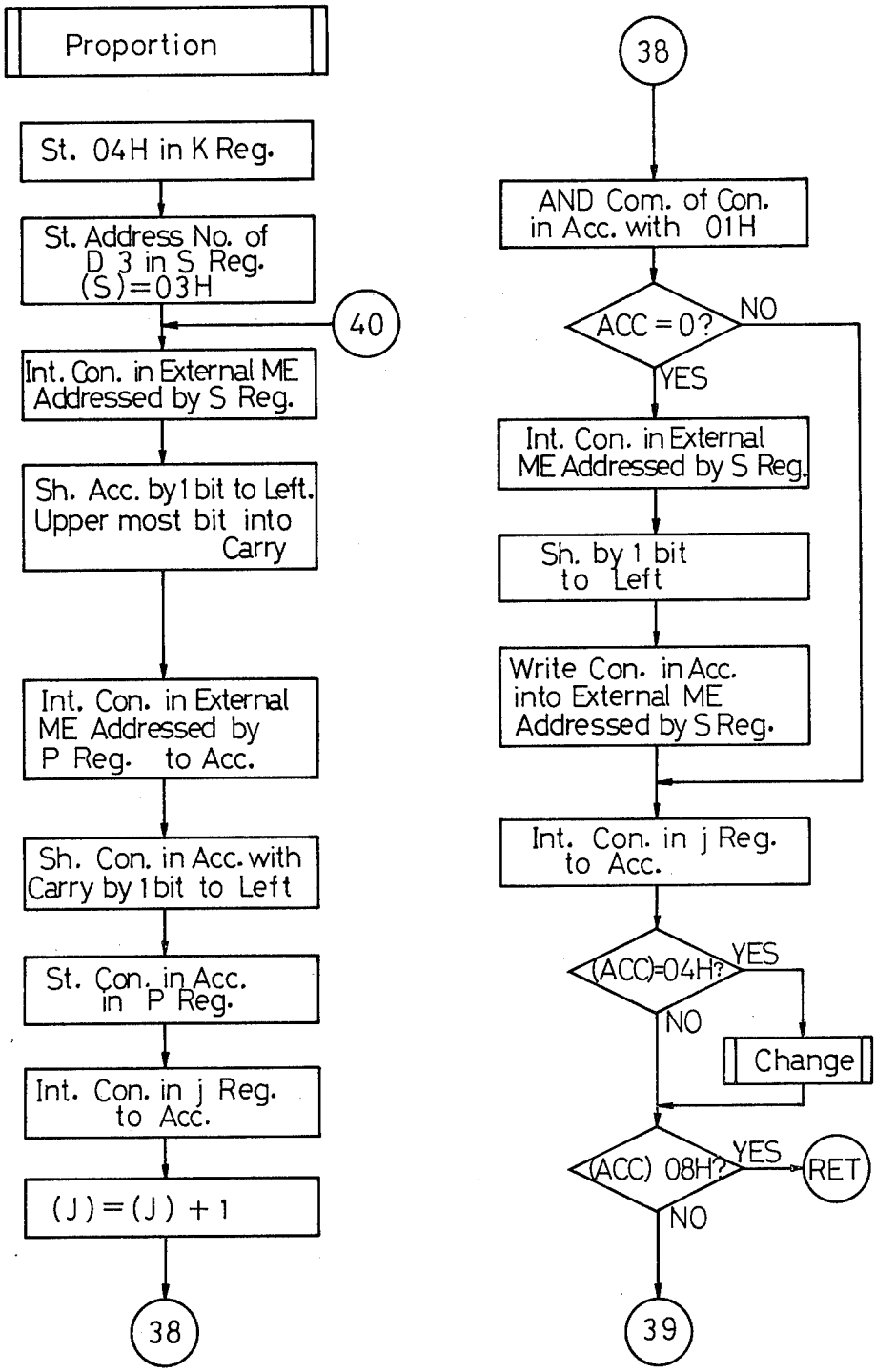
Figure 52:
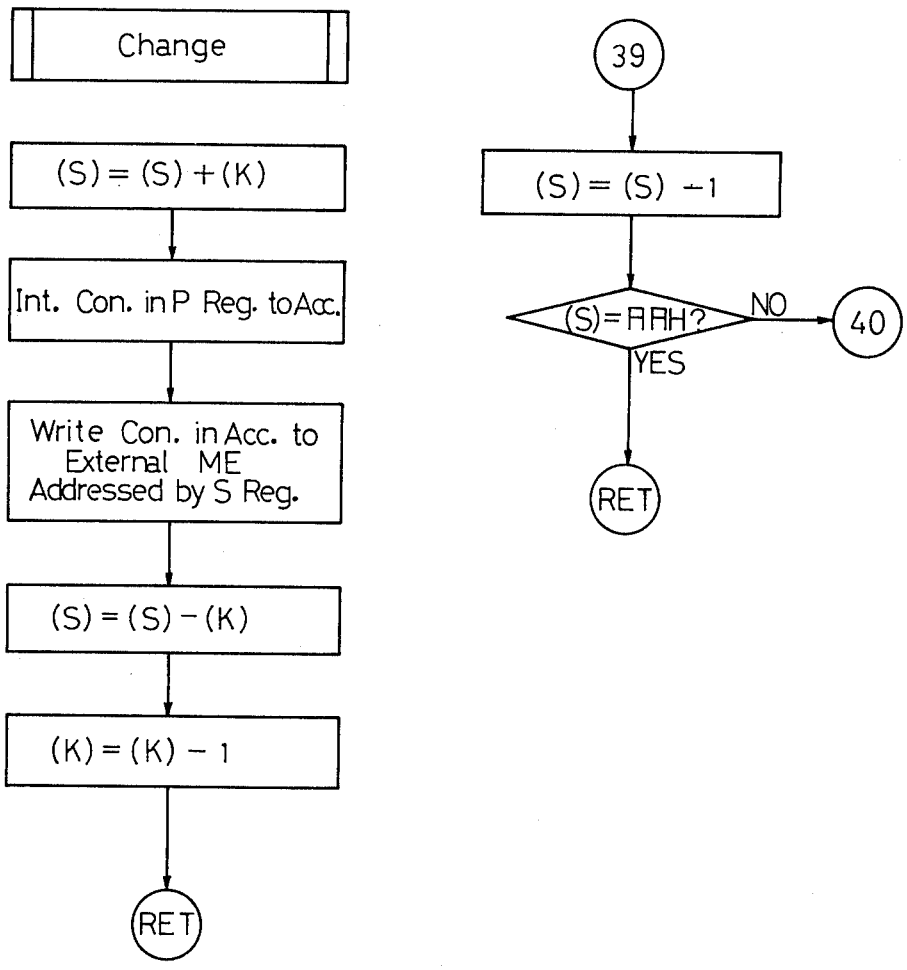

"Formation of Design Pattern" sub-routine, in which new design patterns are fabricated from basic unit design patterns with design No. 1–4 registers, is shown in FIGS. 33 through 45. The "Formation of Design Pattern" sub-routine, is constructed with "Design No. Conversion (DNC)" sub-routine from 2 to 8 as shown in FIG. 33. "Design No. Conversion (DNC) 2" sub-routine appoints a "Standard Address" shown in FIGS. **17*b* and 17*c* for selecting basic unit design pattern. The standard address of each basic unit design pattern (64 patterns) is determined so as to represent each basic unit design pattern. Disposition of the basic unit design patterns on a fabric is determined by "DNC (Design No. Conversion) 3" sub-routine which is shown in FIGS. 34 through 36. In the "DNC 3" sub-routine, disposition of the basic unit design patterns is deciphered with numeral at third figure of key in number, namely with lower 4 bits in design 2 register, then standard addresses are alterred according to the decipherment so as to determine output position (sequence) of basic unit design patterns as shown in FIG. 37. "A" and "B" in FIG. 37 show basic unit design pattern of different kind. Disposition of basic unit design pattern such as a brick wall is obtained from "DNC4" sub-routine shown in FIGS. 38 and 39. In "DNC4" sub-routine, disposition (a) in FIG. 40, which is obtained from "DNC 3", is converted into (b) or (c) in FIG. 40 by changing standard address of basic unit design patterns further in response to upper 4 bits of data of design No. 2 register. Rotation of basic unit design patterns is obtained from "DNC 5" sub-routine shown in FIGS. 42 through 44. "DNC 5" sub-routine supplies out selection signals (design instructions: design data) from upper portion of basic unit design pattern in response to the increase of fabric knitting courses. Namely read out addresses are decreased in response to the increase of fabric courses (Up-Down Conversion). The "DNC 5" sub-routine also stores selection signals appointed by design formation address data in design address 0–7 registers into design 0–7 registers then converts read out of design 0–7 registers so as to supply out selection signals (design data) in right-left exchanged mode (Right-Left Conversion). By selectively combining the Up-Down Conversion with the Right-Left Conversion, rotational combination patterns such as shown in FIG. 41 are obtained. Inversion of design data (design pattern instructions: selection signals) is obtained from "DNC 6" sub-routine shown in FIGS. 45 and 46, in which "Int." means "Introduce", "Exc." means "Exchange", "Conl." means "Control", "Sh" means "Shift" and "DN" means "Design No.". In the "DNC 6" sub-routine, contents in one or more registers of design 0–7 registers corresponding course and block appointed by upper 4 bits of design No. 3 register and disposition of design patterns shown in FIG. 47 are obtained. In "DNC 7" sub-routine (FIG. 46**), one or more basic design patterns are masked to exchange with another kind of basic design patterns in response to lower 4 bits code of design No. 4 register. Combination of inversion by "DNC 6" sub-routine and design data exchange by "DNC 7" sub-routine are shown in FIG. 48. Proportional enlargement of design pattern such as shown (a) in FIG. 49 and slide of design pattern such as shown (b) in FIG. 49 are obtained from "DNC 8" sub-routine shown in FIGS. 50 through 52. The "DNC 8" sub-routine shifts design data toward right by N, which corresponds to design course number, when upper 4 bits of design No. 4 register is "01". The "DNC 8" sub-routine also enlarges design data proportionally by twice when upper 4 bits of design No. 4 register is "02". Exchange of design is finished after introducing "01H" into design set register.

There is comprised "Design Course Block" sub-routine (FIGS. 34 and 35) in the "DNC 3" sub-routine so as to knit course No. which is not required convertion of design code, because there may be one or more knitting course which include no convertion of design code. "Bits Control of Lower FIGS. 0 and 1" sub-routine and "Bits Control of Lower FIGS. 2 and 3" sub-routine in "DNC 3" sub-routine (FIGS. 34 and 36) are employed for converting data of design No. 0–7 registers into that for control register and introduces "00000000" (OOH) into control register when mask code of 2 bits are "00", "10101010" into the register when mask code of 2 bits are "01", "11001100" when mask code are "10", and "11110000" when mask code are "11". "Shift" sub-routine in "DNC 4" sub-routine (FIGS. 38 and 39) shift the data of design address 0–7 registers by 8 bits unit to predetermined registers. In the "DNC 5" sub-routine shown in FIG. 42, "Design Data" sub-routine addresses contents in design address 0–7 registers and introduces design data of them into design 0–7 register. "Change" sub-routine in "Proportion" sub-routine (FIGS. 51 and 52) introduces proportional design data into design 7–0 registers when 8 bits design data are arranged. Programs for another modifications not shown in the drawings may be obtained by modifying the programs described hereinbefore and/or by adding some programs.

Figure 53:
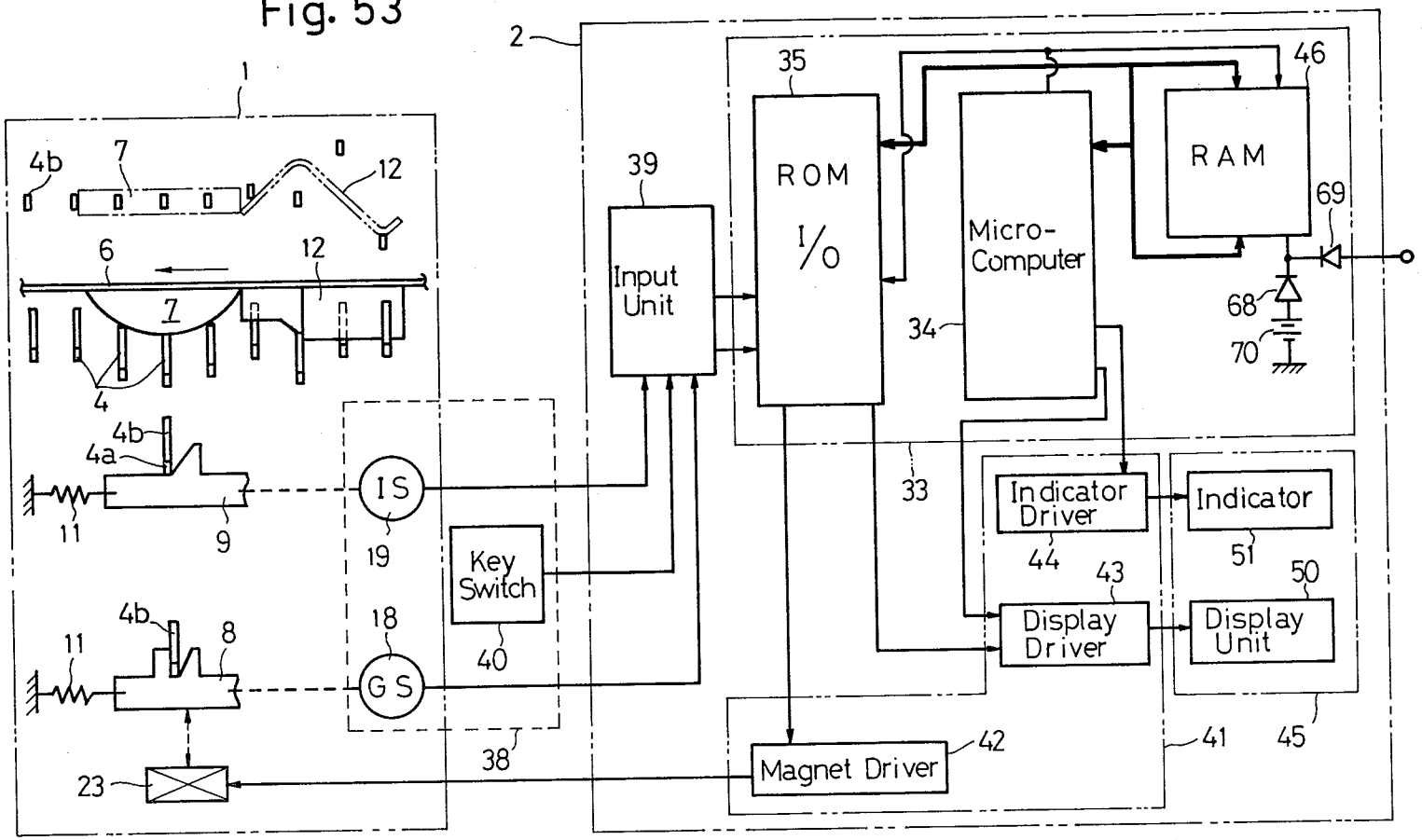
FIG. 53 is a block diagram showing main components of a home knitting machine of another embodiment of the invention and their interelation.

The electronic center control system 33 shown in FIG. 53 has a memory hold circuit for holding knitting data at preceding knitting operation before interruption of knitting a fabric. The memory hold circuit comprises diodes 68 and 69 as well as battery 70. RAM 46 may be nonvolatile memory type and obtained from market, in which case, the memory hold circuit may be eliminated. However in the embodiment shown in FIG. 53, the memory hold circuit is connected with RAM 46 of volatile memory type. RAM 46 is a read and write memory of CMOS semiconductor which requires small quantity of power to maintain memory on it. During the time when main power source is applied to electric part 2, RAM 46 operates with the power from main power source, whereas RAM 46 hold memory on it with power from battery 70 during interruption of main power source. Data on the internal RAM of micro-computer 34 is memorized on RAM 46 when "Memory" key switch is closed. By closing additional "Read Out" key (16H), data on RAM46 is memorized on the internal RAM of microcomputer 34.

Figure 54:
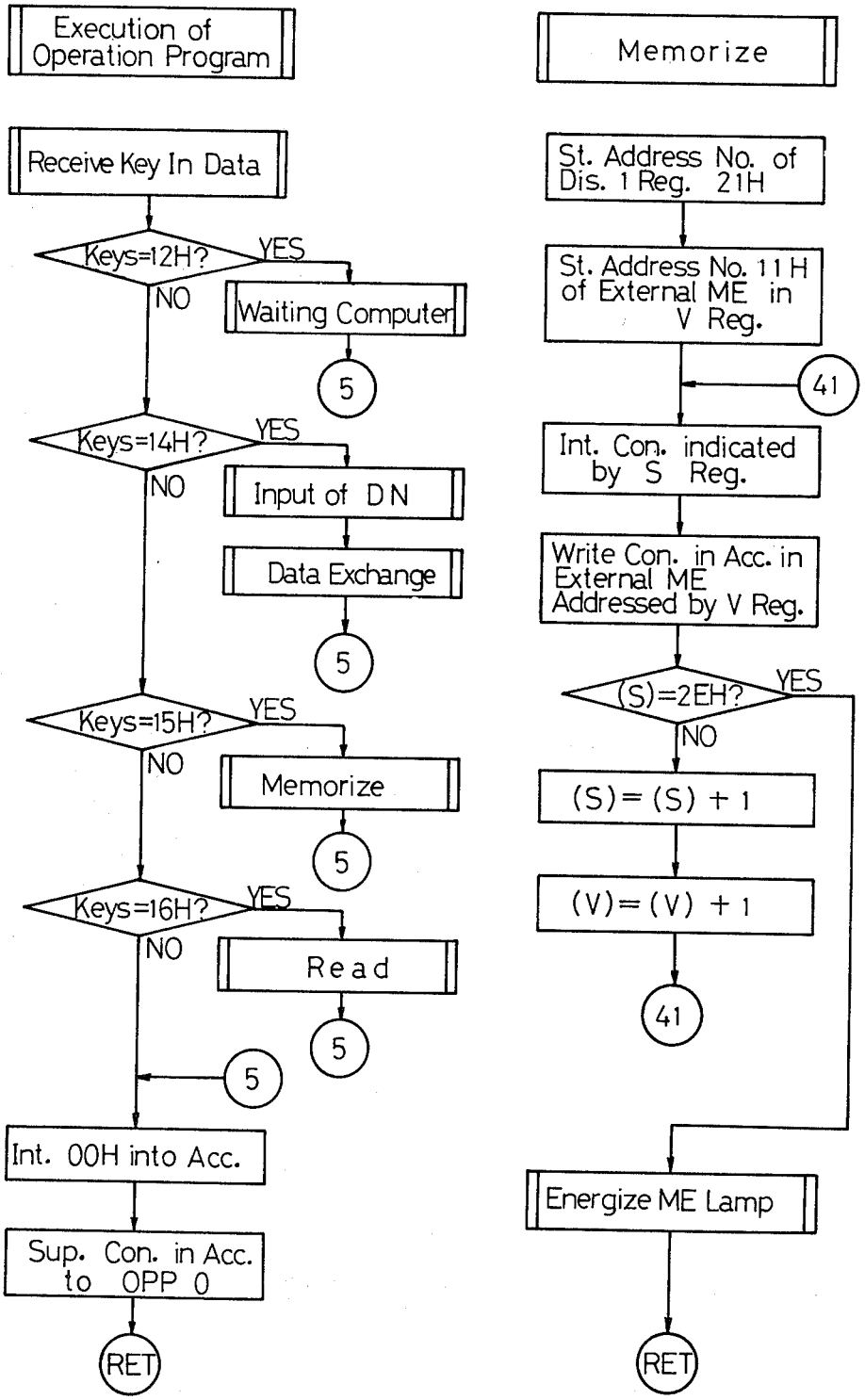
FIGS. 54 and 55 are flow diagrams showing operation of the micro-computor system 33 shown in FIG. 53.
Figure 55:
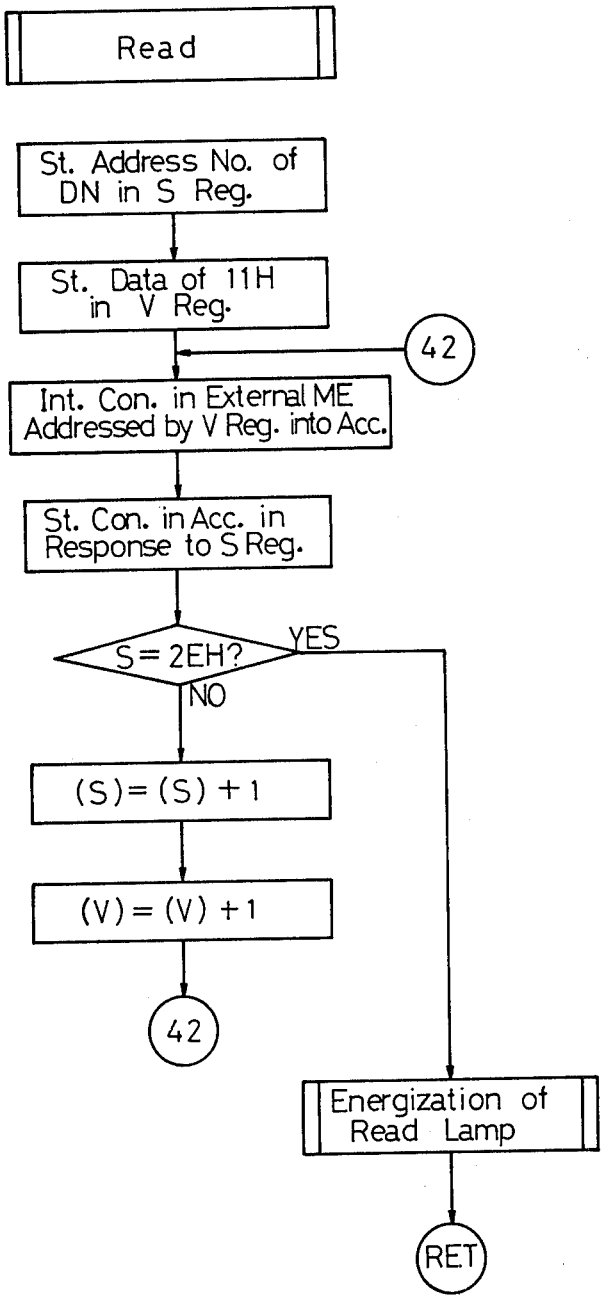

"Execution of Operation Program" sub-routine for the embodiment shown in FIG. 53 is shown in FIGS. 54 and 55. The sub-routine include a "Memorize" sub-routine and "Read" sub-routine, former of which is shown in FIG. 54 and latter is shown in FIG. 55. When "Memory" key switch is closed by operator, "Memorize" sub-routine begins to read out data from display 1 register in sequence and write then on RAM46 from address No. 11H. After reading out all memory from internal RAM of micro-computer 34 and memorizing them on external RAM46, "Memory lamp" (ME lamp) is energized to inform that operator the memorization is finished. Operator thereafter may interrupt main power source to interrupt knitting. At the biginning of knitting of a fabric of precedingly interrupted, operator closes "Read Out" key switch (16H). Closure of the key switch (16H) is detected to operate "Read" sub-routine in which data on RAM46 are read out from address No. 11H and memorized on internal RAM in micro-computer 34. At the end of this reading out, "Read Lamp" is energized to inform operator with "Energization of Read Lamp" sub-routine. Thus, closing "Memory" key switch before interruption of main power source, data on display 1–5 registers, design No. 1–5 registers and knitting course data are memorized on RAM46. After interruption of main power source, battery supplies stand-by power to RAM 46 to maintain the memory. Applying main power source and closing "Read Out" key switch, the data on RAM46 are read out and memorized on internal RAM of micro-computer 34. The operator can operate the home knitting machine again in continuance with the fabric interrupted before.

According to the present invention, selection and set of knitting design pattern is quite easy for operator, because basic unit design pattern instructions as well as fabrication programs to knit specific combination design patterns are preliminary memorized on read only memory as fixed instructions and a specific design pattern instruction is set in the home machine by pushing keys to input specific design indication code of 8 figures. Design patterns and corresponding design indication codes may be printed on cards or instruction book for user's reference. Partial modification of design pattern is possible by key operation during knitting of a fabric. Therefore operator can create her modified design pattern on a fabric at will by key operation. In response to key operations, input data are displayed on display unit 50 and indicator 51 for confirmation. Instruction data of programs may be utilized for basic unit design patterns, in which case variety of basic unit design patterns, especially that have minute irregular disposition of design stitch, are increased. Generally speaking, the larger the memory capacity, the larger and higher the memory device and its cost. For example, a punch card for prior home knitting machine has memory of 1 K bites. Therefore memory capacity of 20 K bites might be required to read only memory device for memorizing data of 20 cards. However according to the present invention, specific combination design patterns of $16^8$ may be obtained by memorizing basic unit design pattern data within 4 K bites and design pattern fabrication programs within 4 K bites. Therefore specific combination design patterns of more than 2000 can be selected and set excluding similar or unhopeful design patterns, in the design patterns of $16^8$. Thus many variety of knitting design patterns are obtained from read only memory device of small memory capacity according to the present invention. Read in operation of punch cards or print cards is eliminated.

In the preferred embodiment of the present invention, knitting data before interruption of knitting are preferably memorized on RAM which is nonvolatile with itself or has a memory hold circuit. Thus the knitting data are held during interruption of main power to eliminate set adjustment at succeeding continuation of knitting.

Obviously many modifications and variations of the present invention are possible in the light of the above teachings, for example, it is preferable to have a RAM memory device to memorize one or more original basic unit design patterns and/or original design fabrication programs in response to operator's key operation. It is therefore to be understood that, within the scope of the appended claims, the invention may be practiced otherwise than as specifically disclosed.

The invention claimed is:

1. A home knitting machine for producing programmed designs comprising:

a needle bed supporting a plurality of needles in side by side relation;

a carriage mounted on the bed for movement traversing the needles;

detection means for generating carriage position signals in response to traversing movement of the carriage;

needle selection means for selecting needles to knit a design pattern in response to design pattern data;

an electronic control system including a semiconductor read only memory device having two separate sections, one for storing basic design pattern unit data and the other for storing specific design fabrication programs said two separate sections functioning together to yield specific combination design patterns in response to a series of design fabrication instructions, said electronic control system further comprising a central control unit for supplying out design pattern data in accordance with appointed programs in response to the carriage position signal; and key switches for appointing codes corresponding to the specific programs to the electronic control system.

2. A home knitting machine for producing programmed designs as claimed in claim 1 wherein the home knitting machine further comprising a display device for displaying an indication of the code appointed by the key switches.

3. A home knitting machine for producing programmed designs as claimed in claim 1, wherein the central control unit is a microcomputer.

4. A home knitting machine for producing programmed designs as claimed in claim 3 wherein the electronic control system is a micro-computer system.

5. A home knitting machine for producing programmed designs as claimed in claim 1, wherein the electronic control system further includes a read and write memory device in which knitting information including keyed in data, such as design pattern positions, and fabrication data, such as a carriage position and appointed programs, are memorized in response to key switch actuation.

6. A home knitting machine for producing programmed designs as claimed in claim 5, wherein the read and write memory device is a nonvolatile memory type.

7. A home knitting machine for producing programmed designs as claimed in claim 5, wherein the read and write memory device is provided with a memory hold circuit.

* * * * *